US006004127A

United States Patent [19]

Heimberg et al.

[11] Patent Number: 6,004,127

[45] Date of Patent: Dec. 21, 1999

[54] OIL BURNER

[75] Inventors: Wolfgang Heimberg, Ebersberg; Wolfram Hellmich, Munich; Franz Kogl, Kaufbeuren; Reinhold Ficht, Kirchseeon, all of Germany

[73] Assignee: Ficht GmbH & Co. KG, Germany

[21] Appl. No.: 08/737,353

[22] PCT Filed: Jun. 14, 1995

[86] PCT No.: PCT/EP95/02317

§ 371 Date: Nov. 1, 1996

§ 102(e) Date: Nov. 1, 1996

[87] PCT Pub. No.: WO95/34786

PCT Pub. Date: Dec. 21, 1995

[30] Foreign Application Priority Data

Jun. 16, 1994 [DE] Germany ..... 44 21 145

[51] Int. Cl.[6] ..... F23C 5/00

[52] U.S. Cl. ..... 431/179; 431/1; 431/159; 251/129.15; 251/129.05; 251/129.21

[58] Field of Search ..... 431/1, 2, 159, 431/174, 181, 356; 251/129.15, 129.05, 96, 129.21; 236/15 A

[56] References Cited

U.S. PATENT DOCUMENTS

| | | | |
|---|---|---|---|
| 2,577,853 | 12/1951 | Kurata | 239/99 |
| 2,971,470 | 2/1961 | Wein et al. | 417/568 |
| 3,070,024 | 12/1962 | Romberg | 417/417 |
| 3,145,931 | 8/1964 | Cleall | 239/102.2 |
| 3,217,780 | 11/1965 | Cremer et al. | 431/1 |
| 3,219,095 | 11/1965 | Nilsson | 236/15 A |
| 3,476,128 | 11/1969 | Barker | 137/1 |
| 4,157,786 | 6/1979 | Bergquist | 236/15 A |
| 4,391,580 | 7/1983 | Hunsberger | 431/1 |
| 4,457,691 | 7/1984 | Hisaoka et al. | 431/1 |
| 4,568,265 | 2/1986 | Firey | 431/1 |
| 5,538,219 | 7/1996 | Osterbrink | 251/129.15 |

FOREIGN PATENT DOCUMENTS

| | | |
|---|---|---|
| GM 1758236 | 12/1957 | Germany . |
| 23 54 708 | 5/1974 | Germany . |
| 120154 | 6/1976 | Germany . |
| GM 74 24 412 | 10/1978 | Germany . |
| 33 38 741 | 4/1984 | Germany . |
| WO 92 14925 | 9/1992 | Germany . |
| GM 93 1412 | 3/1994 | Germany . |
| 578 155 | 7/1976 | Switzerland . |
| WO 93 18297 | 9/1993 | WIPO . |

*Primary Examiner*—Larry Jones
*Attorney, Agent, or Firm*—Jones & Askew

[57] ABSTRACT

A heating system with a combustion chamber into which fuel is fed via a fuel feed unit in the form of an injection device which operates on the energy-storage principle and has a pump and a nozzle device which delivers bursts of fuel in specified quantities. With this fuel burner, it is possible to select both the quantity of fuel injected and the injection frequency independently of any boundary conditions, thereby optimizing levels of harmful pollutants in the exhaust gas and effectively counteracting resonance vibrations in the burner.

69 Claims, 22 Drawing Sheets

Fig. 7
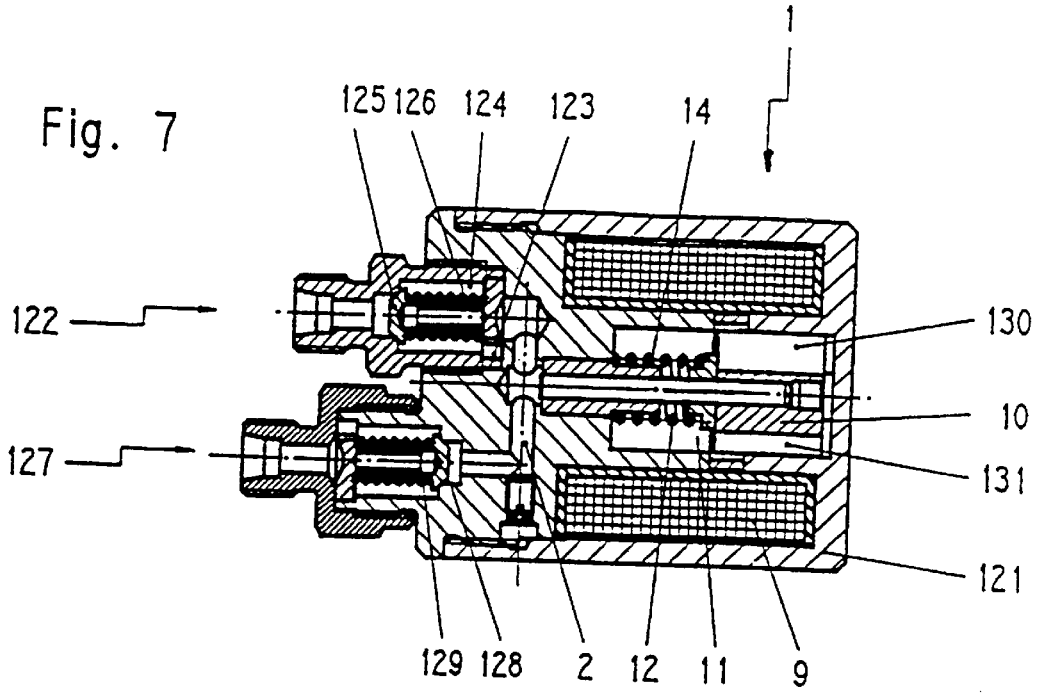
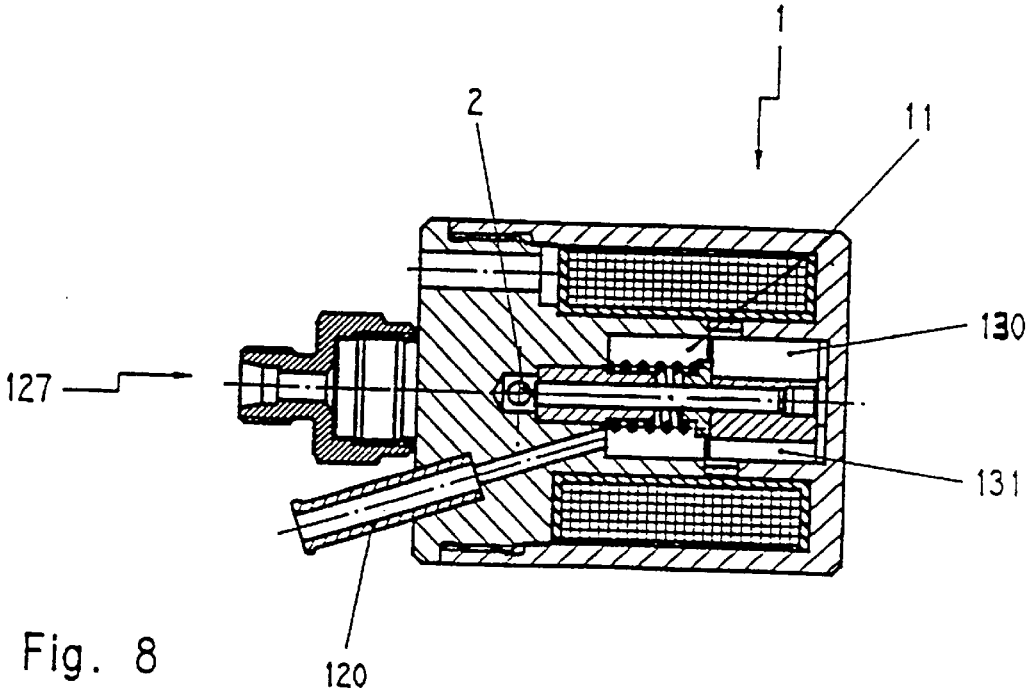
Fig. 8

OIL BURNER

FIELD OF THE INVENTION

The invention relates to an oil burner for heating systems.

BACKGROUND OF THE INVENTION

Oil burners for heating systems conventionally comprise a combustion chamber into which fuel is continually fed via a nozzle.

Oil burners, particularly larger burners, are subject to resonance vibrations, the vibration behaviour of which in oil burners is caused by the combustion space and the nature of the air feed which together form a resonant body.

In the case of gas burners, operated at the resonant frequency, as is described for instance in WO 92/08928 or WO 82/00097, the causes of such vibrations are known and the thereby resulting disadvantages are combated by a variety of means.

Due to the inertia of the gas flowing into a feed pipe a vacuum materializes in the combustion chamber following combustion, as a result of which, on the one hand, gas and air are drawn in and, on the other, a return flow of hot combustion gases occurs which ignite the subsequent fuel mixture inflow. Accordingly, a cyclic process materializes which pulsates at a frequency which substantially depends on the dimensioning of the combustion chamber and feed pipe or feed conduit and the nature of the gas concerned.

Such pulsed operated burners may also create an enormous noise which is in the range of roughly 90 to 140 db(A). This is why in WO 92/08928 a system is provided which decouples the resonance system of the combustion chamber and fuel feed conduit acoustically from the downstream heat exchanger. The resonant frequency occuring in the case of these pulsed burners is of the order of a few 100 Hz and depends on the shape and size of the cavities formed by the combustion chamber and feed conduits.

In the case of gas burners an attempt is also made to prevent the occurence of resonance vibrations by means of damping cavities which are arranged around the gas feed conduit. One such arrangement is known, for example, from DE 33 24 805 A1.

As far as simple small oil burners are concerned which are suitable for operating the heating systems of small houses and should not in general be operated pulsed, resonance vibrations occuring may not only create a noise nuisance, but also result in the oil burner being ruined.

In addition to this, it is known that oil burners as compared to gas burners pose a greater emission problem, caused, on the one hand, by the constitutents contained in the fuel oil and, on the other, by a poorer atomization of occasionaly viscous oil in the combustion chamber so that it is difficult to achieve completely stoichiometric combustion. Also, the oil feed conduits for the continual oil feed tend to dribble which results in a poor combustion as regards emission pollution.

For internal combustion engines very many different kinds of fuel injection devices have been known for a long time. These fuel injection devices are, as a rule, configured as a pumped nozzle system. The pumps employed are solenoid-operated, in which the plunger of the pump is impacted by a solenoid-actuated armature. A variety of pumps having piezoelectric actuators is also known.

In DE-OS 23 07 435 a fuel injection device for internal combustion engines is described in which the pump working space is connected to the pressure space of at least one hydraulically actuatable spring-loaded injection valve by an electrically driven plunger pump and is in connection with a source of pressure via a feed valve. On commencement of the pumping action the plunger exercises a certain idle stroke as a result of which the mass of the plunger is accelerated prior to the actual pumping stroke and the stored kinetic energy is made use of to boost the pressure in the pump working space. For this purpose the injection device comprises as the plunger a soft iron armature which is driven by a linear motor over a relatively long distance.

Such injection devices operating on the energy-storage principle have subsequently been further developed, corresponding injection devices being known from DD-PS 120 514 and DD-PS 213 427. These fuel injection devices operating on the solid-state energy storage principle accelerate the armature of the solenoid and thus the fuel fluid column over a lengthy distance before the pressure is built up needed to eject the the fuel via the nozzle. These fuel injection devices have the advantage that they suffice with little driving energy and achieve a high working frequency due to the small masses which need to be moved. In addition to this they achieve high pressures.

In accordance with DD-PS 120 514 the fuel delivery unit through which the delivery plunger passes is provided in a first section with an axial arrangement of grooves through which the fuel is able to flow off without building up any substantial pressure thereby, this materializing in the subsequent second section of the fuel delivery unit having no fluid outflow grooves. The delivery plunger is accordingly decelerated by the incompressible fuel, as a result of which a pressure is built up in the fuel which overcomes the resistance of the injection valve so that injection of the fuel materializes. The drawback in this arrangement is that when the delivery plunger plunges into the closed section of the barrel unfavorable gap conditions, namely a large gap width and a small gap length, result in high pressure losses which unfavorably affect the build-up in pressure needed for ejection. This is why it is proposed in DE-PS 213 472 to arrange for an impacter on the barrel so that the loss in pressure despite relative large gap widths is maintained reasonably small. However, here the drawback is that impacter action produces wear of the bodies impacting each other. Furthermore, due to impact the impacter is excited to cause longitudinal vibrations which translate to the fuel where they, as high-frequency pressure fluctuations, have an unfavorable effect on the injection procedure.

From WO 93/18297 a further fuel injection device is evident which operates on the principle of solid-state energy storage. In this arrangement partial quantities of the fuel to be ejected are displaced prior to ejection in the pumping region by a plunger element guided in a pump barrel of a plunger pump actuated by a solenoid during the practically zero-resistance acceleration phase in which the plunger element stores kinetic energy and the displacement is suddenly halted by the means interrupting displacement so that a pressure surge is generated in the fuel located in an enclosed pressure space by the the stored kinetic energy of the plunger element being translated directly to the fuel located in the pressure space. This pressure surge is employed to eject the fuel by an injection nozzle device, the means generating the pressure surge, interrupting displacement are arranged outside of the guiding, fluid-tight contact zone between plunger element and plunger barrel of the plunger pump as a result of which the injected fuel amount can be controlled with high frequency and excellent accuracy. In particular, even small quantities of fuel can be injected precisely metered. A further fuel injection device for internal combustion engines operating on the principle of energy storage is known from WO 92/14925. The configuration of one such conventional injection device will now be described in more detail with reference to FIG. 23. From a fuel tank 601 fuel is fed by means of a fuel pump 602 at a pressure of approximately 3 to 10 bar into a pipe 605 in which a pressure regulator 603 and a damping means 604 are arranged. At the end of the conduit 605 a, for example, solenoid-actuated shut-off valve 606 is provided via which, in the open condition, fuel is fed back accelerated by the pump 602 into the storage tank 601. By abruptly closing the shut-off valve 606 the kinetic energy of the fuel flowing in the conduit 605 and in the conduit 607 is converted into pressure energy. The magnitude of the thereby resulting pressure surge is in the region of 20 to 80 bar, i.e. roughly ten times the flow pressure generated by the pump 602 in the conduit 605 which is also termed a swing pipe. The thus resulting pressure surge at the shut-off valve 606 is made use of to eject the fuel accelerated in this way via an injection nozzle 610 which is connected via a pressure conduit 609 to the valve 606 and thus to the conduit 605.

Due to employing an solenoid-actuatable shut-off valve this known injection device is electronically controllable, more particularly by means of an electronic control unit 608 connected to the valve 606.

The drawback in this fundamental configuration of the injection device which works by energy stored in the fuel, is that priming is necessary to furnish the energy needed to accelerate the fuel fluid column in the swing pipe and which operates continually. This continually operating priming necessitates means for maintaining the flow constant. For this purpose the fuel flow delivered in excess by the pump 602 is diminished by the pressure regulating valve 603 which is in connection with the storage tank 601 via a return conduit. Diminishing the pressure results in a loss of energy and accordingly, in addition to an increase in fuel temperature, in changes in pressure at the injection valve 606, as a result of which the accuracy of injection is impaired. In addition to this, the pressure regulating valve 602 always necessitates a minimum reduced control amount to be able to operate stably which makes for a further loss in energy. Since the flow volume requirement at the injection nozzle 10 depends on the engine speed as well as on the amount to be ejected every time the pressure supply means needs to deliver the flow for full load operation already on idle so that relatively high quantities of fuel need to be reduced by control via the pressure regulating valve 603 with a corresponding loss in energy for the system as a whole.

This is why it is proposed in WO 92/14925 to make the fuel flow required for injection available for each injection procedure only as long as this is necessary as a function of the engine operating conditions in keeping with time and flow requirements. By employing an intermittently operated fuel acceleration pump the need for continual priming is eliminated which is in favor of the energy balance of the injection device. Furthermore, utilization of available energy is optimized by employing a common control means for the acceleration pump and the electrically actuatable delay means, for example by way of a solenoid-actuatable shut-off valve.

Preference is given to a solenoid-actuated plunger pump as the fuel acceleration pump for intermittent operation. However, a diaphragm pump for fuel acceleration may also be provided within the pressure surge means. Instead of an electromagnetic pump drive an electrodynamic, a mechanical or a drive means piezoelement may be provided.

By signalling pump and delay means in common not only the timing of the pump and of the delay means can be optimally adapted but also the frequency and volume of injection can be freely selected by employing a common control, this applying in particular when use is made of a fuel injection device operating on the principle of solid-state energy storage.

It can thus be summarized that prior art provides for, on the one hand, oil burners operating continually which have certain drawbacks, particularly by failing to always satisfy the desired requirements due to resonances and their emission pollution in the case of pressure oscillations and, on the other, a very great variety of injection devices, long since known, in the case of internal combustion engines which are designed especially for the control of small amounts of fuel.

SUMMARY OF THE INVENTION

The invention is based on the object of defining an oil burner for a heating system with which pressure vibrations may be reliably avoided and excellent emission values are attainable.

By providing an oil burner with an injection device which operates on the principle of energy storage, comprising a pump and a nozzle or a valve which injects a defined amount of fuel abruptly into the combustion chambers, the pressure vibrations arising in the resonance range in the case of conventional oil burners can be prevented by a precise control of the frequency. This is achieved especially by the energy storage principle which permits the output of very short pulses at a high frequency and at high pressure. Due to the high pressure a very good atomization of the fuel in the combustion chamber and highly accurate metering are additionally achieved, as a result of which the noxious emission values are maintained low.

The frequency dictated by the injection procedure is preferably selected so that it is spaced away as far as possible from the resonance frequency of the combustion chamber.

By providing the injection device according to the invention it is possible for the first time to control or regulate the fuel oil flow fed to the combustion chamber with an accuracy hitherto unknown, as a result of which a precise setting of the oil/air ratio is possible so that a stoichiometric combustion ratio or one having excess air can be achieved to maintain the noxious components in the emissions low.

By means of the burner in accordance with the invention a greater regulation range as regards the oil feed amount is also achieved so that both very small amounts of oil as well as large amounts of oil can be fed to the combustion chamber with high precision, this applying in particular when in addition to the variable frequency the amount of fuel defined per injection procedure can be varied. This large regulation range enables the critical burner conditions to be avoided by very simple means.

The success of the device according to the invention is based on the fact that the resulting vibrations and noxious emissions are not combated by compensating means such as, for example, anti-vibration means, but instead are prevented directly where they would otherwise arise by controlling and/or regulating the flame itself. Accordingly, several approaches in solving the problems occuring in combustion, each of which is active in a different location in the oil burner, are no longer needed, these problems now being solvable solely by the injection device.

The abrupt fuel oil feed (fuel burst) of the injection device according to the invention permits injection pulses of less than 10 ms down to the order of magnitude of 1 ms so that they are suitable to counteract the usual resonance vibrations of a few 100 Hz.

The fast response of the injection device according to the invention also reliably prevents any overshoot in control of the oil feed which cannot be avoided in the case of conventional oil burners and which leads to increased emission pollution. Furthermore, due to its fast response the oil burner according to the invention may be operated in a closed control circuit which by means of a gas sensor senses the gases resulting in the flue or in the combustion chamber and regulates them to predetermined values of low noxious emissions with high thermal effectiveness. Such gas sensors may be sensitive for instance to oxygen or carbon monoxide.

The injection device comprises preferably a solenoid-driven pump to permit handling the pump deliveries of a few kg/h up to 900 kg/h necessary in the case of oil burners, especially large-capacity burners. Such pumps with solenoid drive, operating on the principle of energy storage comprise a solenoid-driven plunger having a plunger element guided in a pump barrel which displaces partial quantities of the fuel to be injected during a practically zero-resistance acceleration phase, during which the plunger element stores kinetic energy, prior to injection in the pumping region, and abruptly halts injection by means for interrupting displacement so that a pressure surge is generated in the fuel located in the enclosed pressure space in which the stored kinetic energy of the plunger element is translated directly to the fuel located in the pressure space. This pressure surge is thereby made use of to eject fuel by an injection nozzle device.

It is particularly advantageous when in the fuel injection means operating on the principle of solid-state energy storage the means for generating the pressure surge are arranged outside of the guiding fluid-tight contact portion between plunger element and plunger barrel of the plunger pump so that by simple ways and means a practically zero-wear operating injection valve is achieved which is capable of injecting large quantities of fuel into the combustion chamber with very short injection pulses.

Injection pumps having such a simple configuration which operate on the principle of solid-state energy storage and have few moving parts are to be employed with preference in the case of oil burners since they have a long useful life which is very important in the case of long duration operation of an oil burner.

BRIEF DESCRIPTION OF THE DRAWINGS

The invention will now be described in more detail with reference to the drawing in which FIGS. 1–9, 10*a*, 10*b*, 11, 12*a*, 12*b* and 13–19 are schematic arrangements in longitudinal section through various embodiments of injection devices employed in the case of the oil burner according to the invention.

The oil burners in accordance with the invention are provided with an injection device operating on the principle of energy storage which inject a defined amount of fuel oil abruptly into the combustion chamber.

Injection devices operating on the principle of energy storage can be subdivided into two groups, namely injection devices utilizing the energy stored in the accelerated fuel and those which operate on the principle of solid-state energy storage. In the case of the latter type injection devices an initial partial stroke of the delivery element of the injection pump is provided in which displacement of the fuel results in no pressure increase, the stroke of the delivery element serving energy storage being determined to advantage by a storage volume, e.g. in the form of a vacant volume and a stopper element which, as will be detained later on by way of the example embodiments, may be designed in different ways, for instance in the form of a spring-loaded diaphragm or a spring-loaded plunger element against which the fuel is delivered and which permits displacement of the fuel over a stroke travel "X" of the delivery element; it not being until then, when during displacement the spring-loaded element comes up against an e.g. fixed stopper that an abrupt increase in pressure is created in the fuel so that a displacement of the fuel in the direction of the injection nozzle is affected.

The fuel injection devices specified in the following on the basis of the drawings are known from WO 93/18297, the configuration of which, however, is particularly suitable for use in an oil burner for the reasons cited above.

DETAILED DESCRIPTION OF PREFERRED EMBODIMENTS

Figure 1:
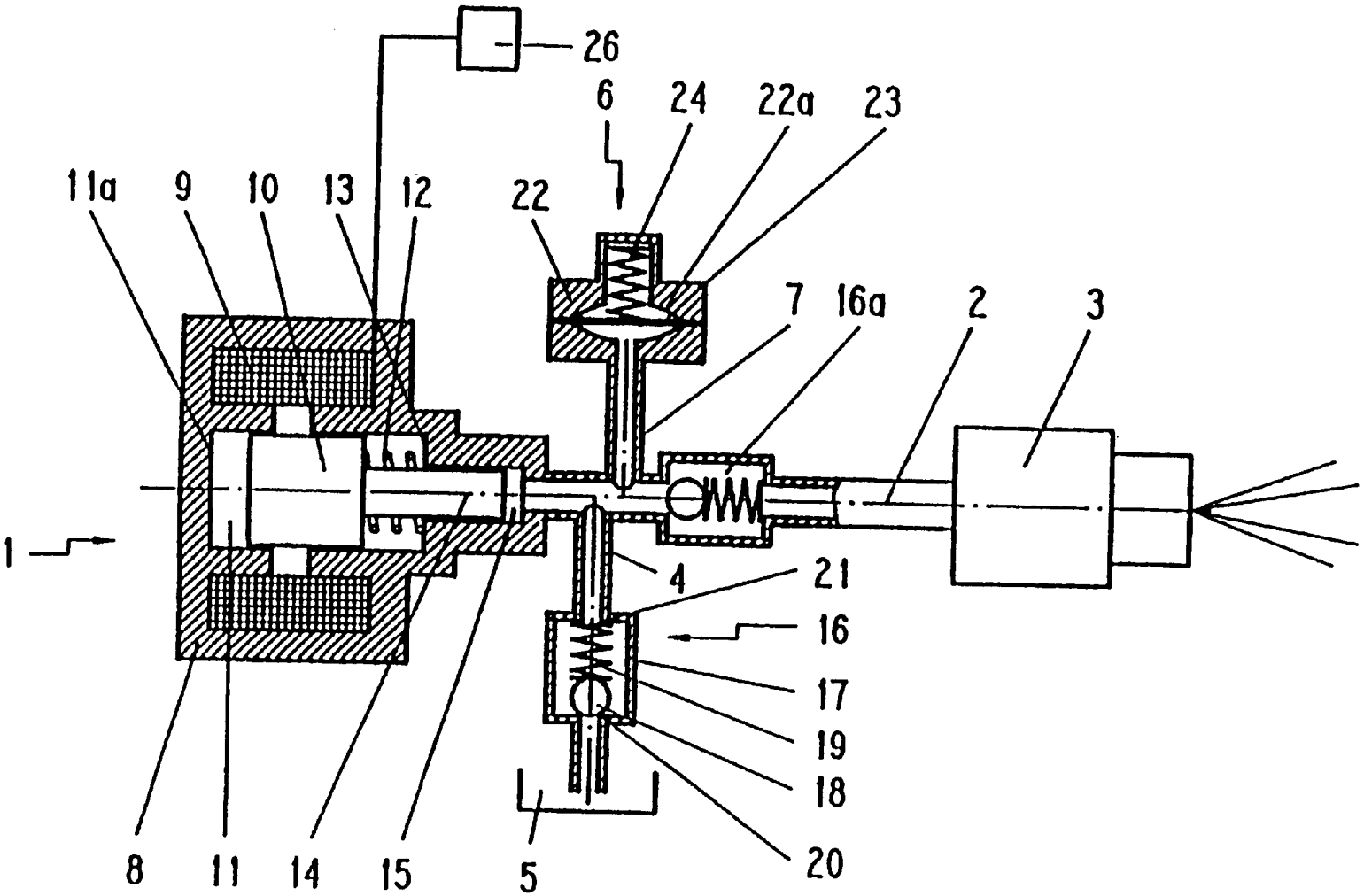

The injection device of FIG. 1 features a solenoid-driven plunger pump 1 which is connected via a delivery conduit 2 to an injection nozzle device 3. Branching off from the delivery conduit 2 is a intake conduit 4 which is connection with a fuel supply tank 5. In addition, a volume storage element 6 is connected via a conduit 7 roughly in the connecting region of the intake conduit 4.

The pump 1 is configured as a plunger pump and comprises a housing 8 in which a solenoid 9 is located, an armature arranged in the region of the solenoid passage, this armature being configured as a cylindrical body, for example, as a solid body and guided in a drilled passageway 11 of the housing located in the region of the central longitudinal axis of the ring-type solenoid 9 and forced into a starting position by means of a compression spring 12, it being in contact with the bottom 11*a* of the drilled passage 11 of the housing in this position. The compression spring 12 is supported by the end face of the armature 10 on the injection nozzle side and by a ring-shaped ridge 13 of the drilled passage 11 in the housing opposite said end face. The spring 12 is a clearance fit around a delivery plunger 14 which is fixedly connected, e.g. integrally to the armature 10 at the armature end face urged by the spring 12. The delivery plunger 14 plunges relatively deeply into a cylindrical fuel delivery space 15 which is configured coaxially as an axial extension of the drilled passage 11 of the pump housing 8 and is in connection translationally with the pressure conduit 2. Due to the plunging depth, losses in pressure can be avoided during the abrupt increase in pressure, whereby the production tolerances between plunger 14 and barrel 15 may even be relatively large, e.g. merely in the region of hundredths of a millimeter so that the expense of manufacture is slight.

In the intake conduit 4 a check valve 16 is arranged, In the body 17 of the valve 16 a ball 18, for example, is arranged as the valve element which is held in its resting position against its valve seat 20 at the supply tank side of the valve body 17 by a spring 19. For this purpose the spring 19 is supported, on the one hand, at the ball 18 and, on the other, at the wall of the body 17 opposite the valve seat 20 in the region of the port 22 of the intake conduit 4.

The storage element 6 features an e.g. two-part configured housing 22, in the cavity of which, as the member to be displaced, a diaphragm 23 is clamped which is separated from the cavity by a space filled with fuel on the pressure conduit side and which in the relaxed condition divides the cavity into two halves which are sealed off from each other by the diaphragm. On the side of the diaphragm 23 facing away from the conduit 7 a spring force, e.g. a spring 24 acts on said diaphragm in a vacant space, the storage volume, said spring being engineered as the return spring for the diaphragm 23. At its end opposite the diaphragm the spring 24 locates on an inner wall of the cylindrically flared vacant cavity. This vacant cavity of the housing 22 is defined by an arched wall which forms an abutment face 22*a* for the diaphragm 23.

The solenoid 9 of the pump 1 is connected to a control means 26 serving as an electronic control for the injection device. In the no-voltage condition of the solenoid 9 the armature 10 of pump 1 is in contact with the bottom 11*a* due to the preloading of the spring 12. In this arrangement the fuel feed valve 16 is closed and the storage diaphragm 23 is maintained in its position in the housing cavity off of the abutment face 22*a*.

When the solenoid 9 is activated by the control means 26 the armature 10 with the plunger 10 is moved against the force of the spring 12 in the direction of the injection valve 3, the delivery plunger 14 in connection with the armature 10 displacing fuel from the delivery barrel 15 into the space of the storage element 6. The spring forces of the springs 12, 24 are configured relatively soft so that fuel displaced by the delivery plunger 14 during the first partial stroke of the delivery plunger 14 forces the storage diaphragm 23 into the vacant space. Due to this the armature 10 can be accelerated initially almost without any resistance until the storage volume or vacant space volume of the storage element is exhausted by the diaphragm 23 coming up against the arched wall 22*a*. As a result of this the displacement of the fuel is suddenly halted and the fuel abruptly compacted due to the already high kinetic energy of the delivery plunger 14. The kinetic energy of the armature 10 with the delivery plunger 14 affects the fluid, resulting in a pressure surge which flashes through the pressure conduit 2 to the nozzle 3 where it causes ejection of the fuel.

For end of delivery the solenoid 9 is switched OFF. The armature 10 is retracted by the spring 12 to the bottom 11a, the volume of fluid stored in the storage means 6 being sucked back via the conduits 7 and 2 into the delivery barrel 15 and the diaphragm 23 forced back into its starting position by the effect of the spring 24. At the same time the fuel feed valve 16 opens so that fuel is replenished by suction from the tank 5.

Expediently a valve 16*a* is arranged in the pressure conduit 2 between the injection valve 3 and the branch points 4, 7 which maintains a standing pressure in the space on the injection valve side which e.g. is higher than the vapor pressure of the fluid at the temperature occuring maximally so that the formation of vapor bubbles is prevented. The standing pressure valve may be configured for instance like the valve 16.

Figure 2:
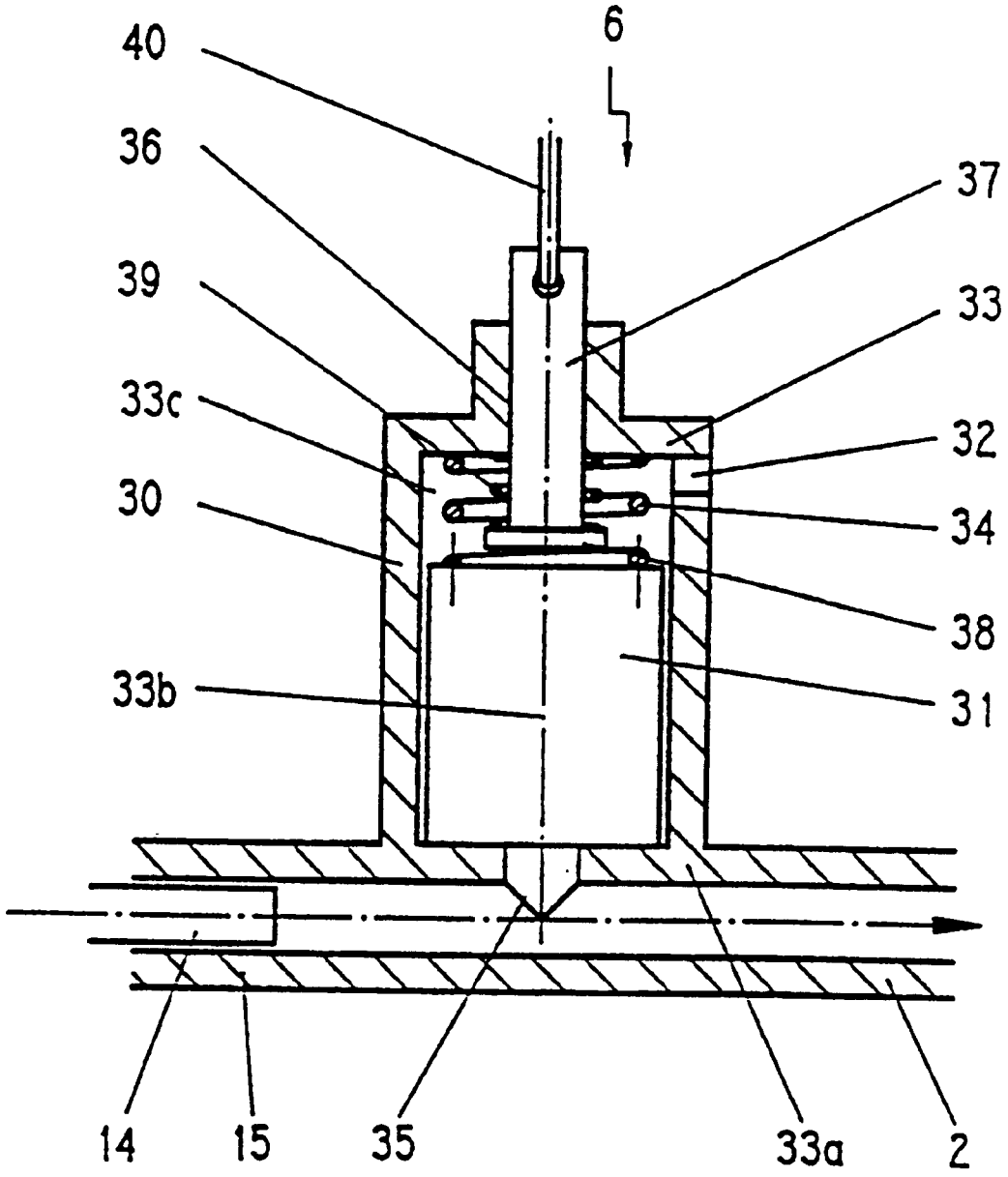

Acting as the displacement member for the storage element 6 a storage plunger 31 may also be employed instead of the diaphragm 23. The stopper which in this case suddenly halts storage, may be configured according to the invention adjustable, so that the travel of the acceleration stroke of armature 10 and delivery plunger 14 can be varied, for instance, manually by an adjuster element which translates the adjusted travel to a displacement plunger 31 via a sheathed cable 40. As an alternative the adjustment may be controlled expediently by the control means 26, for example, by means of an actuator solenoid. FIG. 2 shows e.g. an example embodiment of the storage element 6 with a displacement plunger 31 adjustable by a sheathed cable 40.

The storage element 6 in accordance with FIG. 2 has a cylindrical housing 30 which may be configured integrally with the pressure conduit 2. A storage plunger 31 serves as the displacement member which is guided by a close fit on the inner wall of the cylindrical housing 30 so that no appreciable leakage can occur. In this arrangement a vacant space 33*c* is provided in the cylinder 30 into which the plunger 31 can be displaced. Existing leakage fluid is able to escape through an outflow passage 32 from the vacant space 33*c* and is fed to the fuel tank 5 (see FIG. 1). The outflow passage 32 is configured in the cylindrical wall of the housing 30 in the region of the housing cover 33 opposing the housing wall 33*a* which is configured integrally with a wall section of the pressure conduit 2. The delivery plunger 32 is oriented more or less radially to the longitudinal center axis 33*b* of the cylindrical housing 30.

Between the inside surface of the housing cover 33 and the end face of the plunger 31 opposing this wall a compression spring 34 is clamped in place which forces the plunger 31 into its resting position against the opposing end wall 33*a* of the housing in which a drilled passage 35 is configured which is located in the longitudinal center axis 33*b* of the housing 30 and ports in the pressure conduit 2.

The housing cover 33 of the housing 30 is elongated tubularly in the axial direction and in the passageway of this tubular extension 36 a stopper pin 37 is slidingly guided, like a plunger, which includes a ring 38 at its end located in the space 33*c*. The plunger 31 abuts against the underside of the ring 38 when it is moved from its resting position in the direction of the housing cover 33. This storage element 37 is mounted preloaded by means of a spring 39. For this purpose the spring 39 is supported, on the one hand, by the inside surface of the cover 33 and, on the other, by the ring-shaped ridge of the ring 38 of the pin 37. Secured to the part of the pin 37 arranged outside of the cylinder 30 is the sheathed cable 40. Via the sheathed cable 40 the stopper pin 37 is adjustable in the direction of the longitudinal center axis 33*b* of the housing 30 so that also the possible plunging travel of the plunger 31 can be varied according to the position of the baulk ring 38. The storage plunger 37 can be adjusted according to the necessary acceleration stroke of the armature 10 of the pump 1 (FIG. 1).

The functioning of the storage element 6 as shown in FIG. 2 corresponds substantially to that of the storage element shown in FIG. 1. In a first partial stroke of the delivery plunger 14 and armature 10 (FIG. 1) the storage plunger 31 of the storage element 6 is forced by fuel displacement from its resting position shown in FIG. 2, the return spring 34 being configured relatively soft so that the fuel moved by the delivery plunger 14 seated on the armature 10 can be displaced practically without any resistance of the storage plunger 31. As a result of this the armature 10 with the delivery plunger 14 is accelerated over part of the stroke practically with no resistance, i.e. it needing to overcome substantially merely the force of the springs 12, 34, until the storage plunger 31 comes up against the baulk ring 38 by its spring-loaded end face, so that the fuel located in the delivery barrel 15 and in the pressure conduit 2 is compacted abruptly due to the high kinetic energy of the armature 10 and delivery plunger 14, this kinetic energy being translated to the fluid. The resulting pressure surge then causes fuel ejection via the nozzle 3.

The adjustable stop pin 37 is also suitable for exclusive control of the amount of fuel to be injected.

Figure 3:
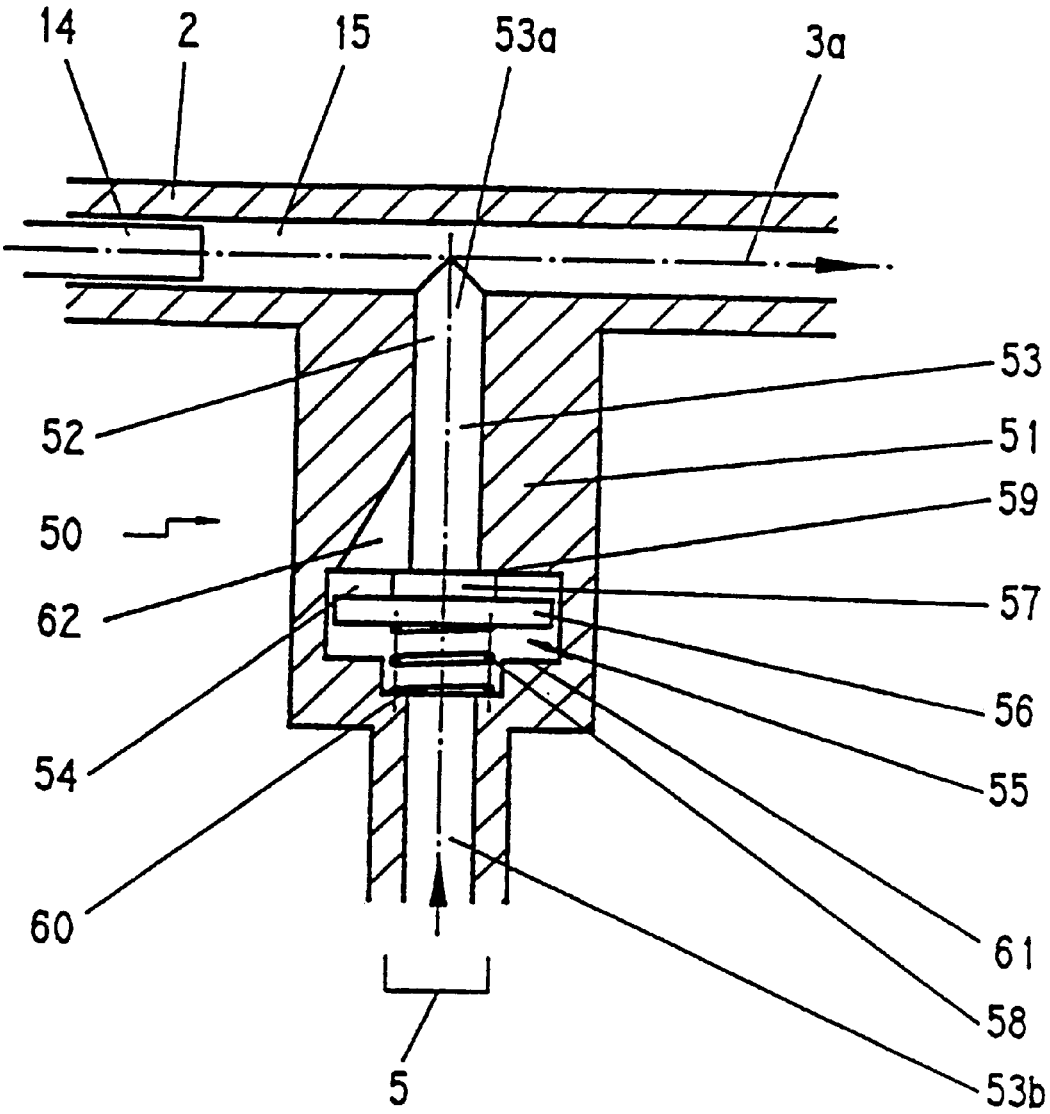

In accordance with a further advantageous embodiment of the invention it is provided for that the fuel feed valve (valve 16 in FIG. 1) is configured so that it additionally acts as a storage element (corresponding to storage element 6 in FIGS. 1 and 2) so that fuel is derived with practically no resistance on a first partial stroke of the delivery plunger from the delivery barrel 15 and the pressure conduit 2 into a storage volume, this storage element also determining the travel of the first partial stroke of the delivery plunger 14. FIG. 3 shows a first embodiment of a fuel feed valve configured in such a way which also ensures the function of a storage element in defining the first partial stroke of the delivery plunger. One advantage afforded by this compact variant of the invention is that instead of two components as shown in FIGS. 1 and 2, namely a fuel fuel feed valve and a separate storage element, merely a single component is involved.

The valve 50 includes a substantially cylindrically configured body 51 which in the example embodiment depicted is configured integral with the pressure conduit 2. In the body 51 a full-length drilled passageway 52 is provided, comprising a section 53 on the pressure conduit side which ports via an orifice 53*a* into the pressure conduit 2, and a section 53*b* on the suction side, which is connected to the feed conduit leading to the fuel tank 5 (FIG. 1). Between the two coaxial passages 53 and 53*b* in the body 51 a radially flared valve space 54 is formed which accomodates a shut-off valve element 55. This valve element 55 consists of a large-diameter circular disk 56 and a small-diameter circular disk 57, both circular disks being configured integrally and the circular disk 57 of smaller diameter being arranged on the side of the passage section 53. A valve barrel return spring 58 forces the valve element 55 in its resting position against the end face 59 on the pressure conduit side of the valve space 54, the spring 58 being supported on the one hand by the disk 56 of the valve element 55 and, on the other, by the bottom of a ring-shaped ridge 60 arranged centrally in the end face 61 opposite the end face 59 of the valve space 54. The disk 56 is thus able to seal off the end face 61 of the valve space 54.

The passage section 53 of the longitudinal center passage 52 is in connection with the valve space 54 via flutes or grooves 62 arranged in the body wall 51, whereby the former may be configured flared funnel-shaped in the direction of the valve space 54 (see FIG. 3).

Figure 4:
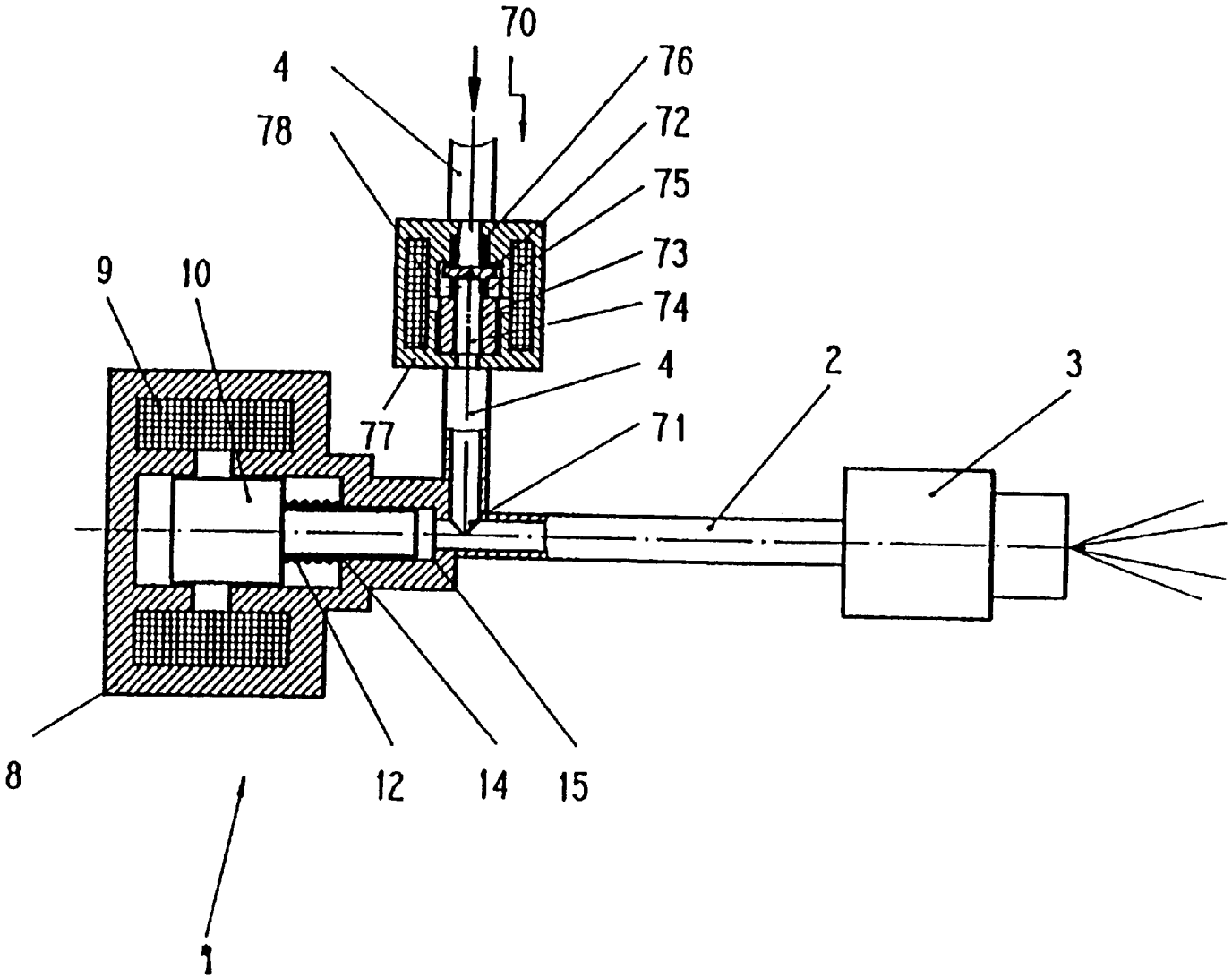

In the starting position shown in FIG. 3 the valve element 55 is in contact with the disk 57 at the end face 59 of the valve space 54. In this position the passage section 53*b* on the storage tank side is flow-connected with the pressure conduit 2 and the delivery barrel 15 via the valve space 54 and the flutes 62 as well as via the passage section 53, the fuel tank means 5 represented symbolically providing a vacant space or storage space into which the fuel can be displaced. When the delivery plunger 14 is accelerated in the direction of the injection nozzle (arrow 3*a*) due to energization of the solenoid, the displaced fuel is able to flow practically with zero resistance through the passage section 53, the flutes or grooves 62, the valve space 54 and the feed passage 53*b* into the fuel tank 5. In this arrangement the flow conditions of the valve 50 are designed so that when the fuel flow has attained a certain velocity the flow forces at the valve element 55 around which the fuel flows become greater than the preloading force of the spring 58, resulting in the valve element 55 being forced towards the drilled passageway 53*b*, it thereby with the disk 56 closing off the feed cross-section of the drilled passage 53*b* and the recess of the ring-shaped ridge 60 respectively which results in an abrupt translation of the kinetic energy of the armature 10 and plunger 14 to the fuel in the delivery barrel 15 and in the pressure conduit 2 so that fuel is ejected via the nozzle 3 (see FIG. 1). In this version of the valve means 50 the energy storage path of the armature 10 and plunger 14 is controllable by energization of the solenoid. The valve element 55 recancels the pressure of the spring 58 from the port of the feed conduit 53*b* when the plunger 14 and armature 10 respectively returns, so that fuel can be replenised by suction from the tank 5. FIG. 4 shows a variant of the component as described above on the basis of FIG. 3 which takes over the function of both the fuel supply and the control of the fuel ejection, the partial stroke of the delivery plunger serving the energy storage being additionally controllable via this component. For this purpose an electrically controllable valve 70 is employed.

At the start of the pressure conduit 2, in the immediate vicinity of the pressure or delivery space 15 of the pump 1, the pressure conduit 2 features an orifice 71 to which the fuel feed conduit 4 is connected, into which the electrically controllable valve 70 is inserted. This valve 70 includes in a valve body 77 a spring-loaded valve plate 72 which is fixedly connected to an armature 73. This armature 73 has a longitudinal center passage 74 and at least one passage 75 arranged transversely to the latter in the region of the valve plate 72. In the resting position the valve 70 is opened by the armature 73 being pressed by a spring 76 pressing against the plate 72 into an end position on the side of the pressure conduit in which the fuel of the tank (not shown) is in connection via the drilled passages 75 and 74 and the pressure conduit orifice 71 with the fuel of the pressure spaces 15, 2.

In the body 77 a solenoid 78 is also arranged which spacingly surrounds the armature 73.

The injection procedure is sequenced according to the invention as follows: when the pressure conduit 2 is totally filled the solenoid 9 of the pump 1 is energized, as a result of which the armature/delivery plunger element 10, 14 of the pump 1 is accelerated from its resting position. The fuel displaced by the plunger 14 flows through the pressure conduit orifice 71, the center drilled passage 74, the transverse drilled passage 75 around the valve plate 72 and into the tank-side portion of the conduit 4 to the fuel tank. At a specified point in time the valve 70 is activated by the solenoid 78 being energized and the armature 73 being moved until the valve plate 72 seats the valve and shuts off the fuel passage. The pressure conduit orifice 71 is blocked abrupt, i.e. very quickly so that no further fuel can escape via the conduit 4. Armature 10 and delivery plunger 14 are accordingly abruptly decelerated and give off the stored kinetic energy to the incompressible fuel which results in a pressure surge causing the fuel to be ejected from the pressure conduit 2 via the injection valve 3, whereby the armature 10 including the plunger 14—the same as in other embodiments of the invention—have either attained its full delivery stroke or is moved even further. By ways and means known as such the injection valve 3 is hydraulically controlled and configured spring-loaded.

Signalling of the valve 70 is done preferably by an electronic control system serving the pump 1 and the shut-off valve 70 in common.

Figure 5:
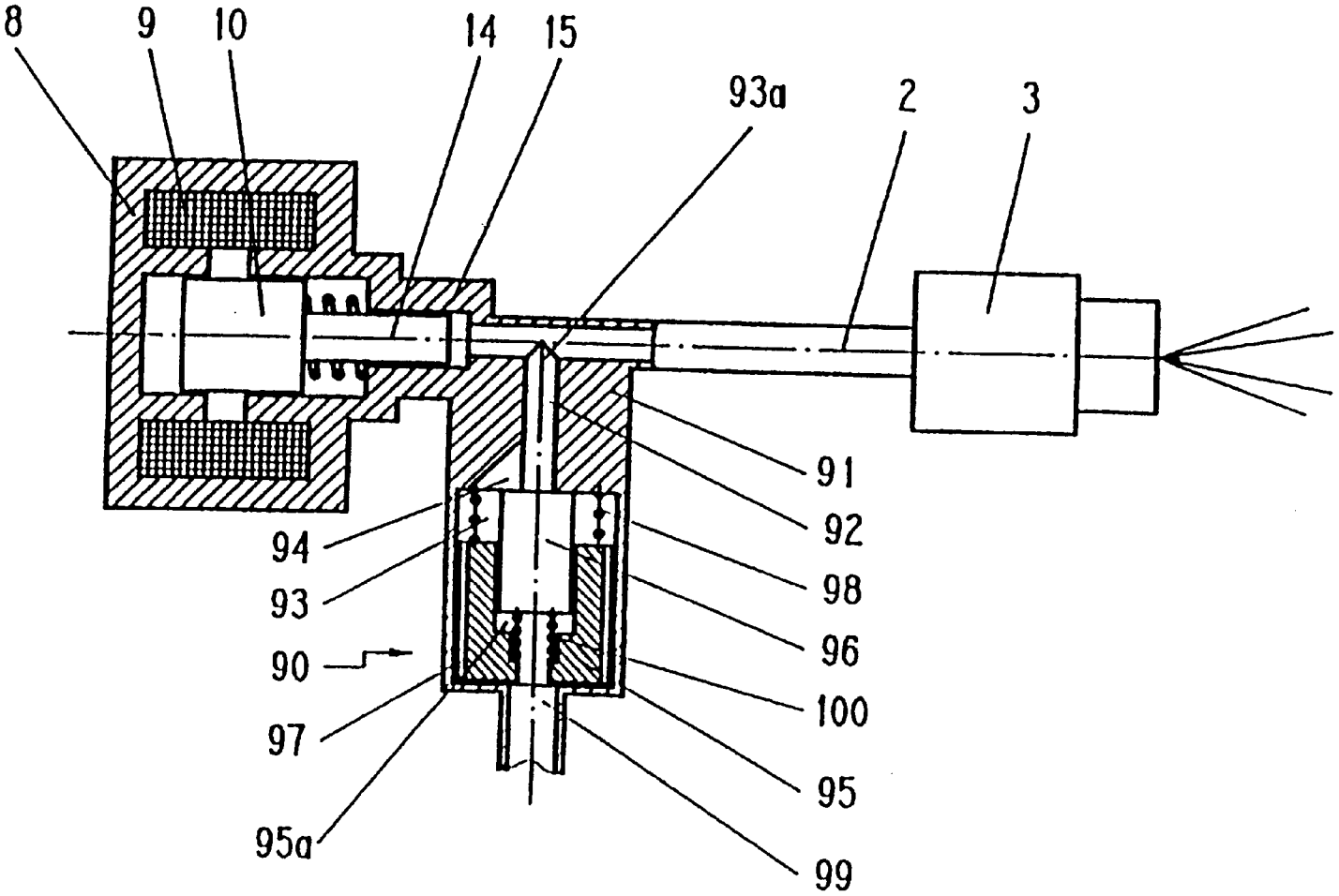

FIG. 5 shows another version of the valve in FIG. 3. The integral storage element feed valve 90 has a body 91 forming a single unit with the housing 8 of the pump 1 and the pressure conduit 2. In the body 91 a longitudinal center passage 92 is provided which ports at one end via an orifice 93*b* in the pressure conduit 2 and at the other end in a cylindrical valve seat 93, flutes 94 similar to the flutes 62 as shown in FIG. 3 leading additionally from the drilled passage 92 to the valve space 93. The valve element is configured two-part and includes a cylinder 95 guided in the valve space 93, a plunger being slidingly guided in the cylindrical full-length central ridged passage of the cylinder 95. In the outer shell surface of the cylinder 95 an axial-parallel arrangement of grooves 97 is configured. The cylinder 95 is forced into its resting position by a spring 98 in which it is seated by its end face on the tank-side bottom of the valve space 93 into which a fuel feed conduit 99 leading from the the fuel tank ports. In the drilled passage for receiving the plunger 96 a spring 100 is seated on the tank side which urges the plunger 96 against the bottom of the valve space 93 on the pressure conduit side so that the drilled passage 92 is covered, a vacant space 95*a* being formed for the plunger 96 in the interior of the cylinder 95 at the tank side.

The valve 90 functions as follows. When the delivery plunger 14 executes a suction stroke fuel is suctioned from the conduit 99 by the cylinder 95 being lifted from the tank-side bottom of the valve space 93 by the vacuum acting against the pressure of the spring 98 so that fuel is able to flow into the pressure conduit 2 via the longitudinal grooves 97, the valve space 93 and the flutes 94 as well as via the drilled passage 92. In this procedure the plunger 96, as shown in FIG. 5, is in contact wit the bottom of the valve space 93 at the pressure conduit side. On termination of the suction stroke the cylinder 95 is urged by the spring 98 into the position shown in FIG. 5 in which the cylinder 95 is again in sealing contact with the bottom of the valve space 93 at the tank side.

At the start of the delivery stroke of the delivery plunger 14 the plunger 96 guided in the cylinder 95 is moved away from its contact position with the bottom of the valve space 93 on the pressure conduit side due to the relatively pliant configuration of the spring force of the spring 100 and is urged into the vacant space 95*a*. In this arrangement fuel flows into the thereby resulting additional space in the valve space 93 from the pressure space 15, 2 as displaced by the delivery movement of the delivery plunger 14, whereby at the tank-side end face of the plunger 96 fuel is forced back by the plunger 96 via the conduit 99 into the tank. The delivery stroke of the delivery plunger 14 is terminated by the plunger 96 coming up against the ridge in the longitudinal center passage of the plunger 95 by its tank-side end face being urged by the spring 100. As a result of this abrupt termination of the acceleration stroke of the armature 10 and delivery plunger 14 substantially with zero resistance a very steep increase in pressure in the pressure conduit 2 is configured, as a result of which fuel is ejected at high pressure via the nozzle 3.

Figure 6:
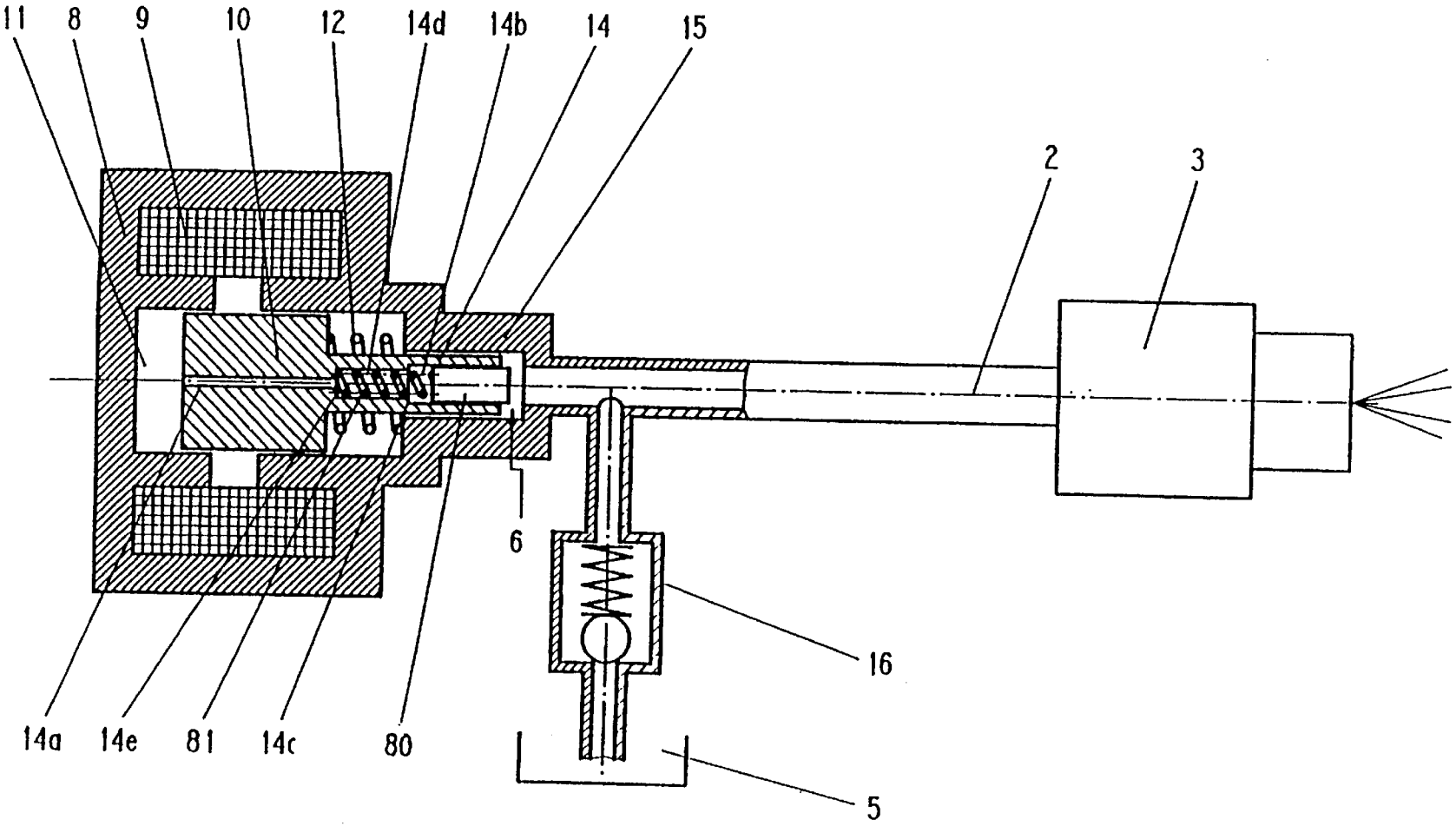

In accordance with a further variant of the invention it is provided for that the storage element 6 is configured as a single unit with the delivery plunger of the plunger pump 1. A corresponding example embodiment is depicted in FIG. 6. Serving as the storage element is a storage plunger 80 which is urged in a first longitudinal center ridged passage section 14*b* on the pressure conduit side of a ridged passage 14*a* passing centrally through the plunger 14 and the armature 10 against a stopper on the pressure conduit side (not shown) by a spring 81. In this arrangement the plunger 80 protrudes in the resting position by its end face into the pressure space 15. The passage section 14*b* in the delivery plunger 14 receiving the storage plunger 80 is continued following the ridge 14*c* in the direction of the armature 10 in a further ridged passage section 14*d*, on the ridge 14*e* of which the compression spring 81 is supported which urges against the armature-side end face of the plunger 80. In conclusion, following the ridge, the drilled passage 14*a* passes through also the armature 10 and ports into the vacant armature space 11 so that air can be displaced.

The storage element of this embodiment functions as follows. On a first portion of the stroke of the delivery plunger 14, the energy storage distance, the storage plunger 80 is urged into the drilled passage of the delivery plunger 14 provided for the plunger, as a result of which an additional space for displaced fuel is available on the pressure space side, so that during the first section of the stroke the armature 10 together with the delivery plunger 14 can be accelerated substantially with zero resistance. This zero-resistance acceleration of the armature 10 and the delivery plunger 14 is concluded when the armature-side end face of the storage plunger 80 comes up against the annular shoulder 14*c* of the ridged passage 14*a*, the result being an abrupt increase in pressure by which fuel is ejected via the nozzle 3.

The variant of the injection device according to the invention as described in the following on the basis of FIGS. 7 and 8 features an electrically driven plunger pump and stopper means in a single unit.

In the example embodiment depicted in FIGS. 7 and 8 a hydraulic valve as well as the pump and the pressure conduit 2 are accommodated in a common housing 121. The function as well as the substantial configuration of the pump with the solenoid drive corresponds substantially to the embodiments of the pump 1 of the device according to the invention as described previously, fuel intake occuring via a valve 122 which is fitted in the pump housing 121 and in connection with the pressure conduit 2 (FIG. 7).

In the example embodiment shown the valve 122 closes automatically due to the Bernoulli effect at a specific flow velocity. The fuel flowing through the pressure conduit 2 during the acceleration phase gains access via a gap 123 to the valve space 124. Between the valve cone 125 and the associated valve seat a narrow annular gap is left which can be varied by correspondingly designed a spring 126 urging the valve cone 125. Fuel flows through this annular gap where it creates by the Bernoulli effect a lesser static pressure than in the surroundings. At a certain flow velocity the static pressure in the annular gap has dropped sufficiently that the valve cone 125 is attracted and the valve 122 closes, as a result of which the pressure surge necessary for ejecting the fuel via the injection nozzle is created. The pressure conduit 2 leading to the injection nozzle is connected to the output of a check valve 127 which is also integrally incorporated in the housing 121.

The valve cone 128 of the valve 127 is urged against the associated valve seat by the preloading of a spring 129, this spring 129 being designed so that the valve 127 is closed when the pressure present in the pressure conduit 2 is below the value resulting in ejection of fuel via the injection nozzle indirectly connected to the valve 127. The check valve 127 also prevents bubbles forming in the pressure conduit 2 leading to the injection nozzle valve due to the check valve enabling a standing pressure in the pressure conduit between injection nozzle and check valve to be assured which is higher than the vapor pressure of the fuel fluid.

The armature 10 in this example embodiment is provided with axially parallel slots 130 and 131 differing in depth in the shell which are arranged distributed about the periphery of the substantially cylindrical armature. These slots prevent the formation of eddy currents on energization of the solenoid 9 and thus contribute towards saving energy. By means of a conduit 120 leading outwardly from the armature space 11 through the housing 121 leakage oil having penetrated into the armature space can be drained off.

Return setting the armature of the injection pump is done as a rule by means of the return spring provided for this purpose. To achieve large injection frequencies the return time of the armature needs to be maintained small. This can be achieved for example by a correspondingly high spring force of the return spring. However, diminishing the return duration increases the impact velocity of the armature on the armature stopper, the wear and/or the bounce of the armature on the armature stopper possibly being a disadvantage since the working cycle duration as a whole is increased. This is why it is one object of the invention to minimize the deenergization time of the armature to the resting position. According to the invention this object is achieved by an e.g. hydraulic damping of the armature return movement in the last portion of this movement.

Figure 9:
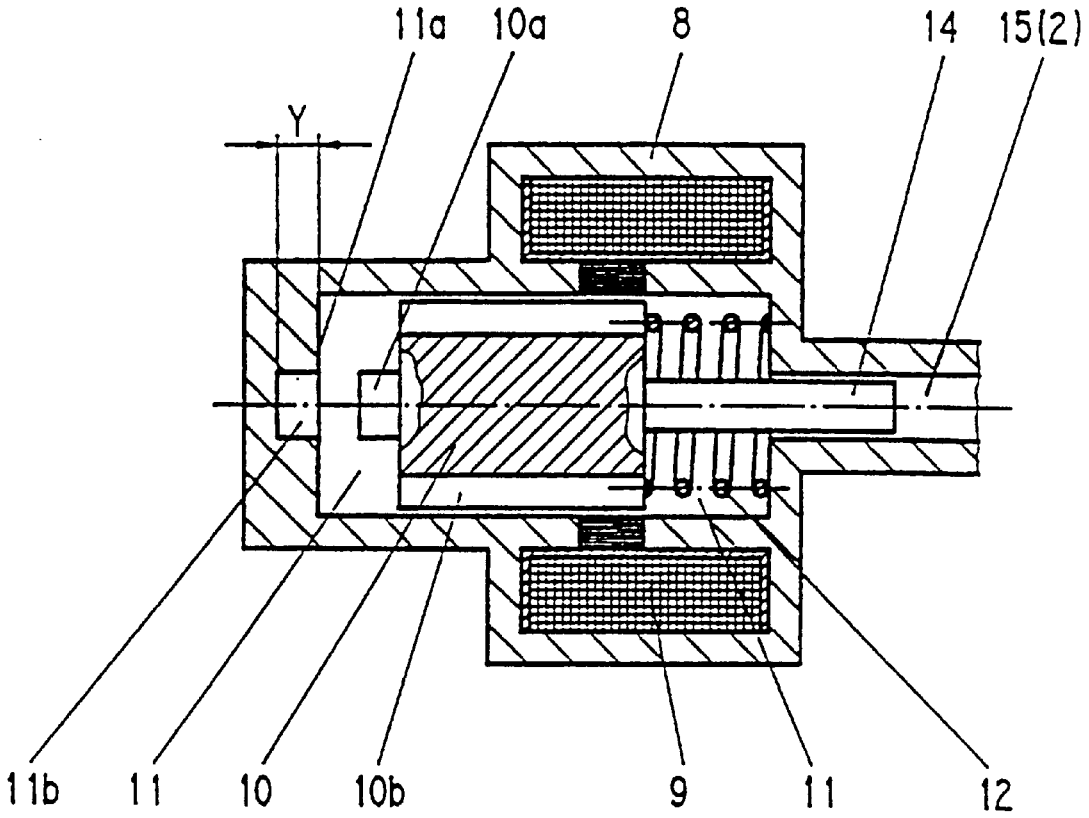

FIG. 9 shows an example embodiment of the injection pump which exhibits substantially the configuration of the injection pump 1 as shown in FIG. 1. For the hydraulic damping a cylindrical protrusion 10*a* is configured on the rear side of the armature 10 by way of a plunger/barrel arrangement, this protrusion being adapted in the last section of the armature return movement to enter, in the bottom 11*a*, a blind cylindrical hole 11*b* which is configured at the abutment face 11*a* for the armature 10 in the housing 8. In the armature 10 grooves 10*b* are configured oriented longitudinally which connect the space 11 on the rear side of the armature to the space 11 on the front side of the armature. In the space 11 a medium, for instance air or fuel, exists which is able to flow through the grooves 10*b* on movement of the armature 10. The depth of the blind cylindrical hole 11*b* roughly corresponds to the length of the protrusion 10*a* (dimension Y in FIG. 12). Due to the protrusion 10*a* being able to plunge into the blind cylindrical hole 11*b* the return movement of the armature in the last section is strongly delayed, as a result of which the desired hydraulic damping of the return movement of the armature is affected by displacement of the medium from the space 11*b*.

Figure 10A:
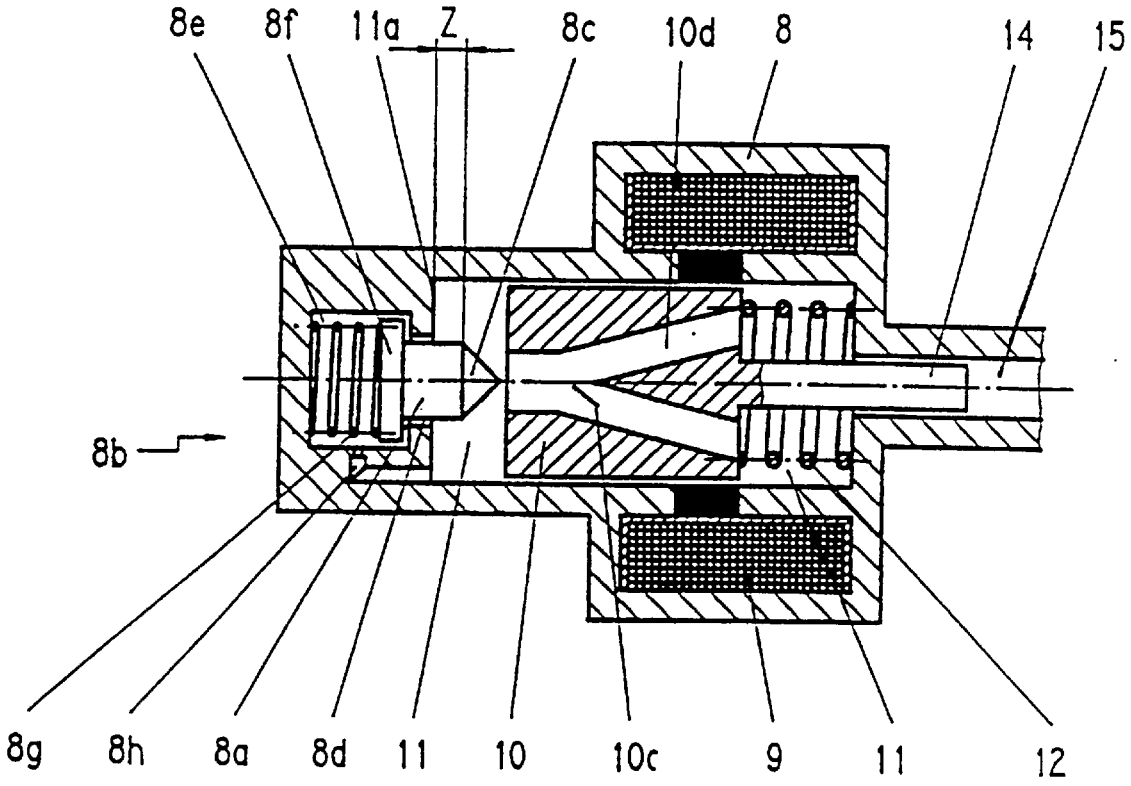

FIG. 10*a* shows a hydraulic damping variant. In this example embodiment too, the pumping psace 11 through which the delivery plunger 14 passes is connected upstream of the armature 10 to the space 11 adjoining the rear side of the armature, i.e. by drilled passages 10*d* which port into a central overflow passage 10*c* in the region of the rear side of the armature. A central pin 8*a* of a shock absorber 8*b* protrudes by its conical tip 8*c* in the direction of the port of the overflow passage 10*c*, rearwardly passing through a hole 8*d* in the bottom 11*a*, porting a damping space 8*e*, and ends in the damping space with a ring 8*f* having a larger diameter than that of the hole 8*d*. A spring 8*g* supported by the bottom of the damping space urges the ring 8*f* and thus the pin 8*a* into its resting position (FIG. 10*a*). A passage 8*h* connectes the damping space 8*e* to the rearward armature space 11. The passages 10*c* and 10*d* permit practically zero-resistance movement of the armature 10 during the acceleration phase.

The damping means 8*b* has no effect in accelerated movement of the armature 10 so that the stroke phase is not detrimented. On return movement the port of the overflow passage comes up against the conical tip 8*c* and is closed off thereby so that flow through the passages 10*c* and 10*d* is discontinued. The armature 10 urges the pin 8*a* against the spring force and the medium present in the space 8*e* which is also present in the space 11 and which flows out via passage 8*h* into space 11. In this arrangement the various flows and spring forces are selected so that optimum damping is assured.

Figure 10B:
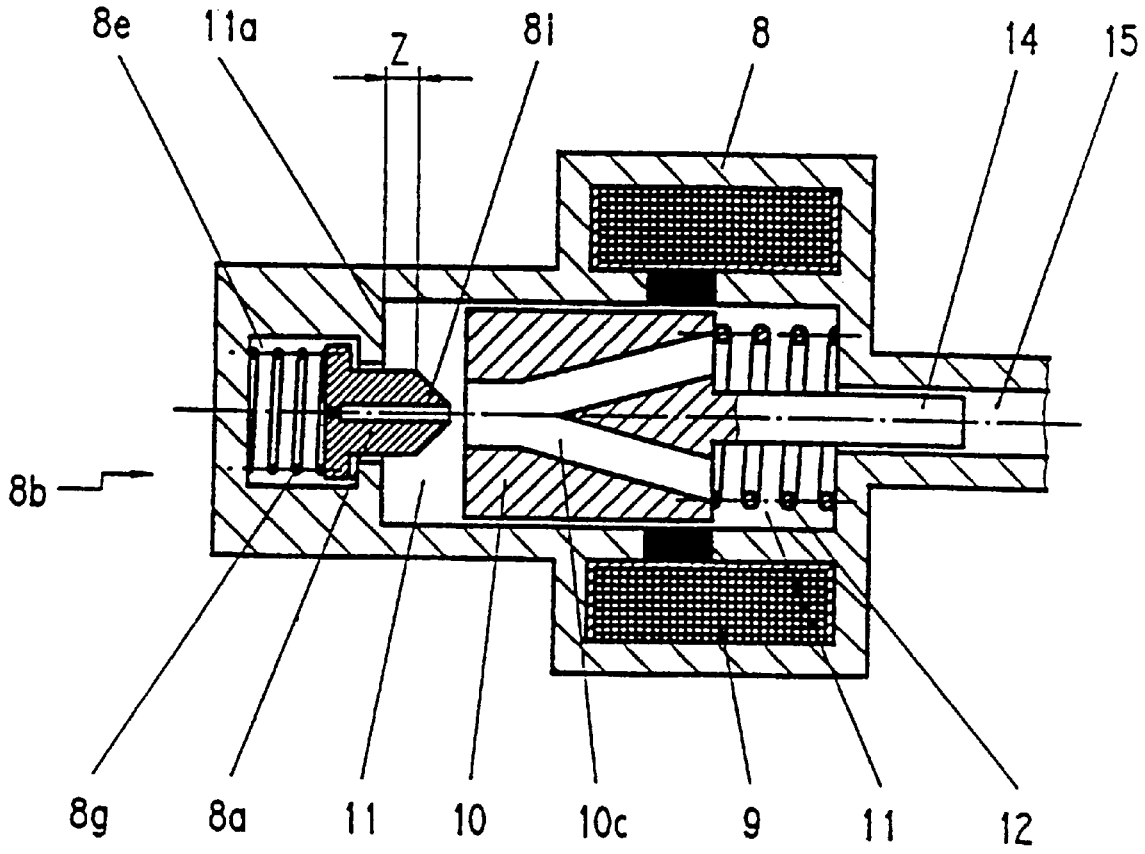

Instead of the passage 8*h*, as evident from FIG. 10*b*, a displacement passage 8*i* may be centrally arranged in the pin 8*a*, through which the damping medium can be forced into the overflow passage 10*c*.

Figure 11:
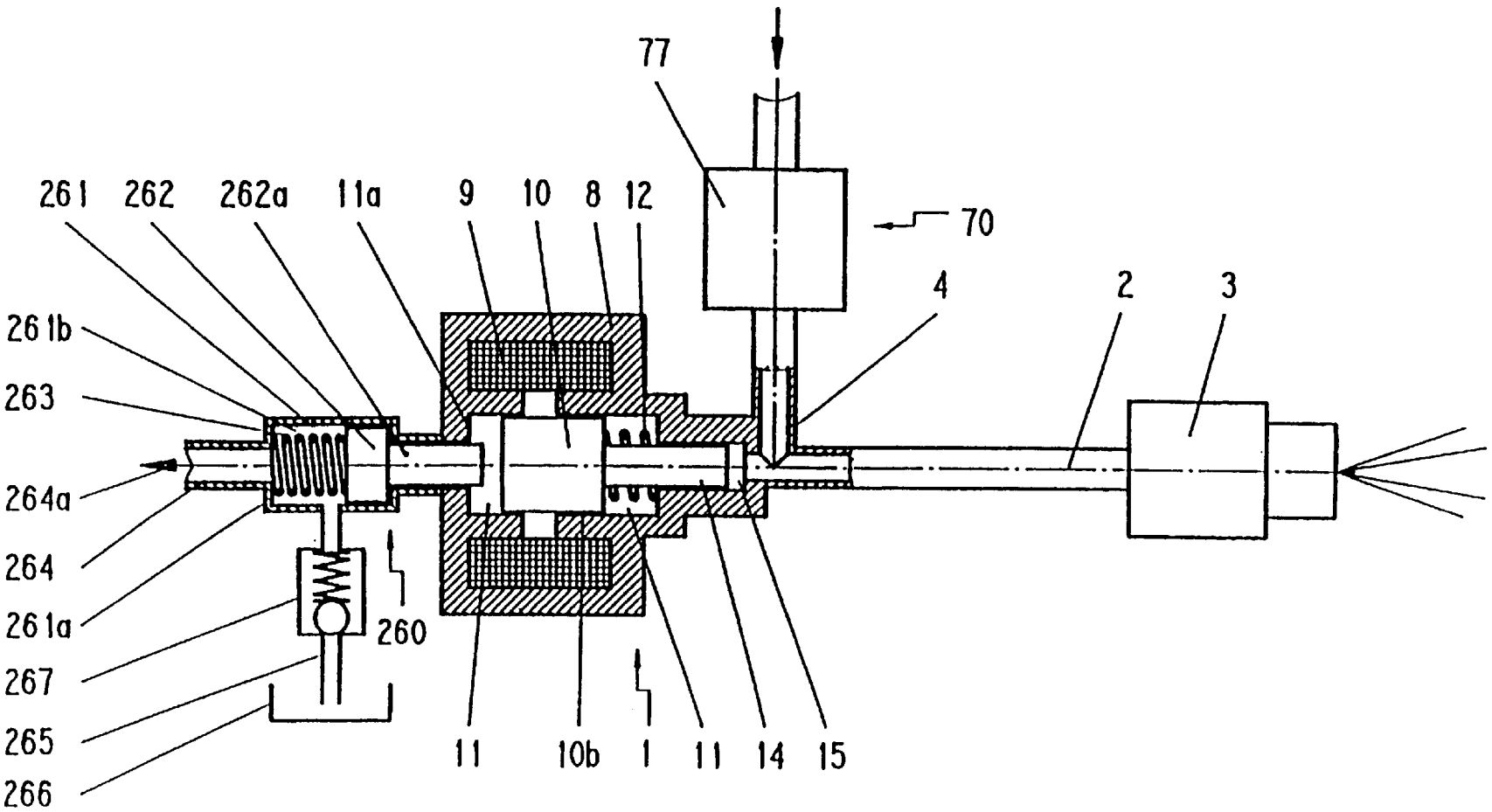

In accordance with a further advantageous aspect of the injection device according to the invention it is provided for that the energy stored in the return spring 12 of the armature 10 is put to use in the return movement of the armature 10. This may be achieved in accordance with the invention, for example, by the armature on return serving a pumping means which may be used for the fuel supply of the injection device for stabilizing the system and for preventing bubbles forming. FIG. 11 shows a corresponding example embodiment of a second pump 260 connected to the fuel injection pump 1.

The fuel injection means shown in FIG. 11 is otherwise configured in accordance with FIG. 4, i.e. it comprising a fuel inflow and outflow control element for controlling the first partial stroke of the delivery plunger 14. The second pump 260 is connected to the rearward bottom 11*a* of the pump housing 8. In detail the second pump 260 comprises a housing 261, which is connected to the housing 8 of the injection pump, and in the pump space 261*b* of which a pump plunger 262 is arranged, the plunger rod 262*a* of which protrudes into the working space 11 of the armature 10, the plunger 262 being urged by a return spring 263 which is supported by the bottom 261*a* of the housing in the region of an outlet 264.

In addition, the pump space 261*b* of the housing is in connection with a storage tank 266 via a feed conduit 265. In the feed conduit 265 a check valve 267 is incorporated, the configuration of which is identical to that of the valve 16 in FIG. 1.

The second pump 260 functions as follows. When the armature 10 of the injection pump 1 is moved during its working stroke in the direction of the injection nozzle 3, the pump space 11 in the housing 8 downstream of the armature 10 is enlargened as regards its volume, as a result of which the pump plunger 262 is moved in the direction of the armature 10 and finally is translated into its resting position by the effect of the return spring 263. Oil is thereby sucked into the working space 261*b* of the second pump from the storage tank 266 via the valve 267. During the return movement of the armature 10 of pump 1 in the direction of its stopper 11*a*, the pump plunger 262 is shifted into the pump space 261*b* at least over part of the return travel, valve 267 being closed by the pump pressure and the medium delivered by the second pump is output by the pump via the outlet 264 in the direction of the arrow 264*a*.

The second pump 260 may be used as a fuel priming pump, whereby the fuel may be fed to the valve means 70, it being of advantage that the pump 260 is able to create a standing pressure in the fuel supply system which counteracts the formation of vapor bubbles e.g. in warming up of the system as a whole.

In addition, the configuration of the additional pump 260 in accordance with the invention causes at the pump 1 a fast damping of the armature 10 so that the armature 10 does not bounce at the stopper 11*a*.

Figure 12A:
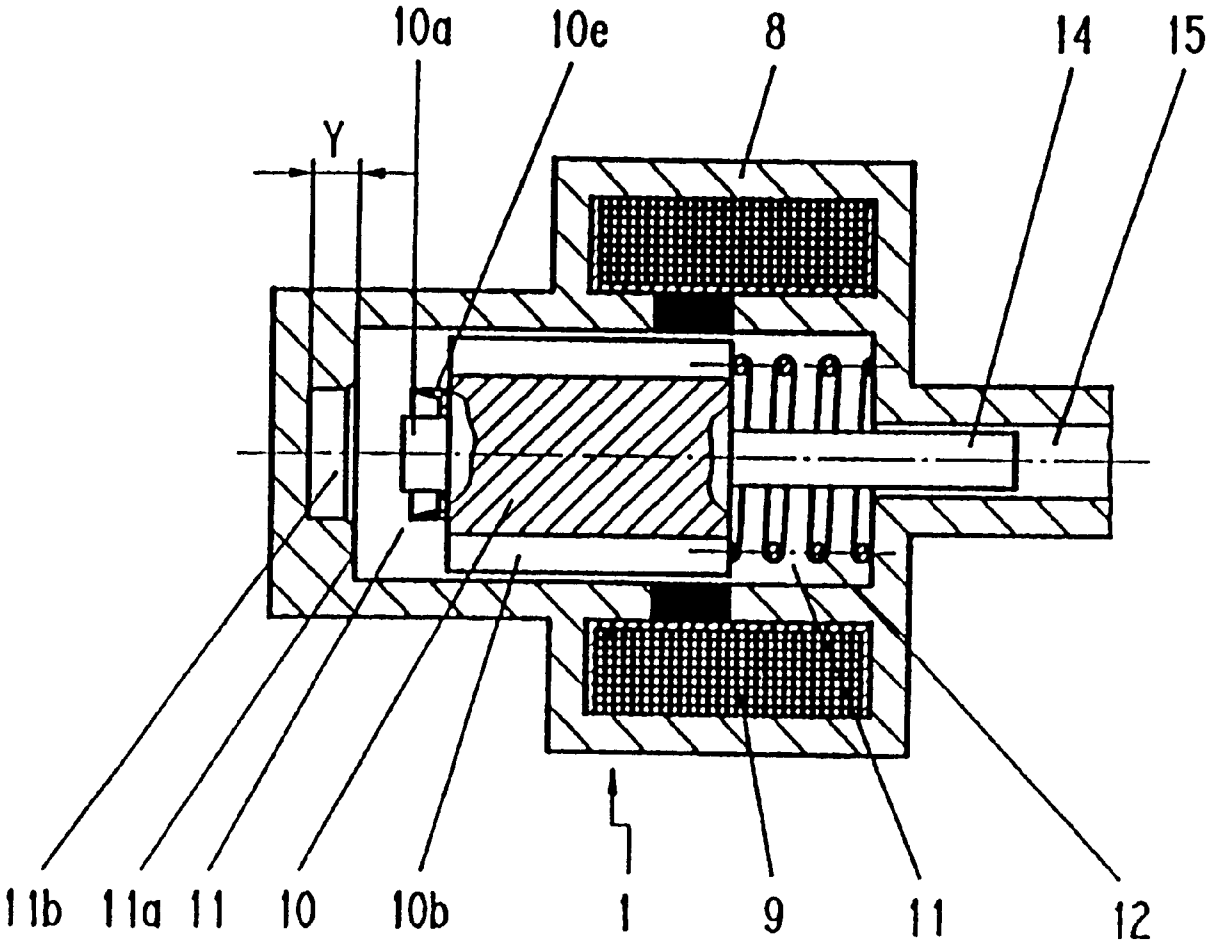
Figure 12B:
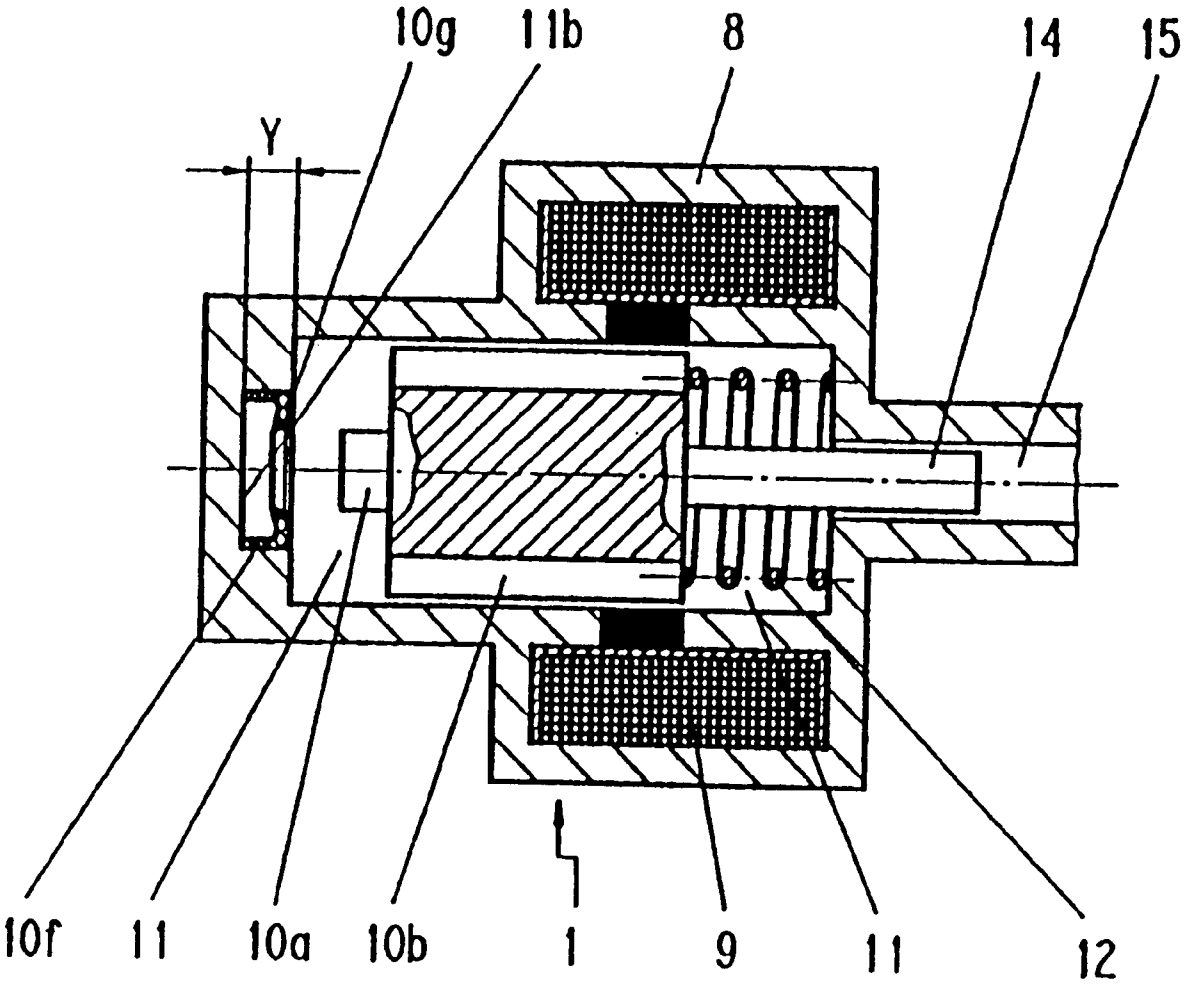

FIGS. 12*a* and 12*b* shows a particularly effective and simple damping means. The configuration of the pumping means 1 is the same as that illustrated in FIG. 9. The blind cylindrical hole 11*b* of FIG. 12*a* is larger in diameter than the diameter of the cylindrical protrusion 10*a*. This protrusion 10*a* is surrounded by a sealing lip ring 10*e* of an elastic material protruding in the direction of the blind cylindrical hole 11*b* to which it is adapted. A guide ramp at the port of the blind cylindrical hole 11*b* facilitates the entry of the lips of the sealing lip ring 10*e* in the blind cylindrical hole 11*b*. This damping means provides good damping in stopping the armature 10 and does not obstruct the acceleration stroke of the armature. The elastic damping element 10*e* having sealing lips projecting axially parallel plunges into the blind cylindrical hole 11*b* with positive contact on the return stroke of the armature 10 and contacts the inner wall of the blind cylindrical hole 11*b* sealing it off to the exterior.

The blind cylindrical hole 11*b* of FIG. 12*b* is also larger in diameter than the cylindrical protrusion 10*a*. A sealing ring 10*f* of elastic material is seated in positive contact with the wall of the blind cylindrical hole 11*b* and features in the region of the port sealing lips 10*g* oriented inwardly. The cylindrical protrusion 10*a* plunges plunger-like into the elastic sealing element 10*f*, the sealing lips 10*g* being pressed against the cylindrical protrusion 10*a* as a result of the out-flowing damping medium so that good damping of the armature 10 is achieved.

Figure 13:
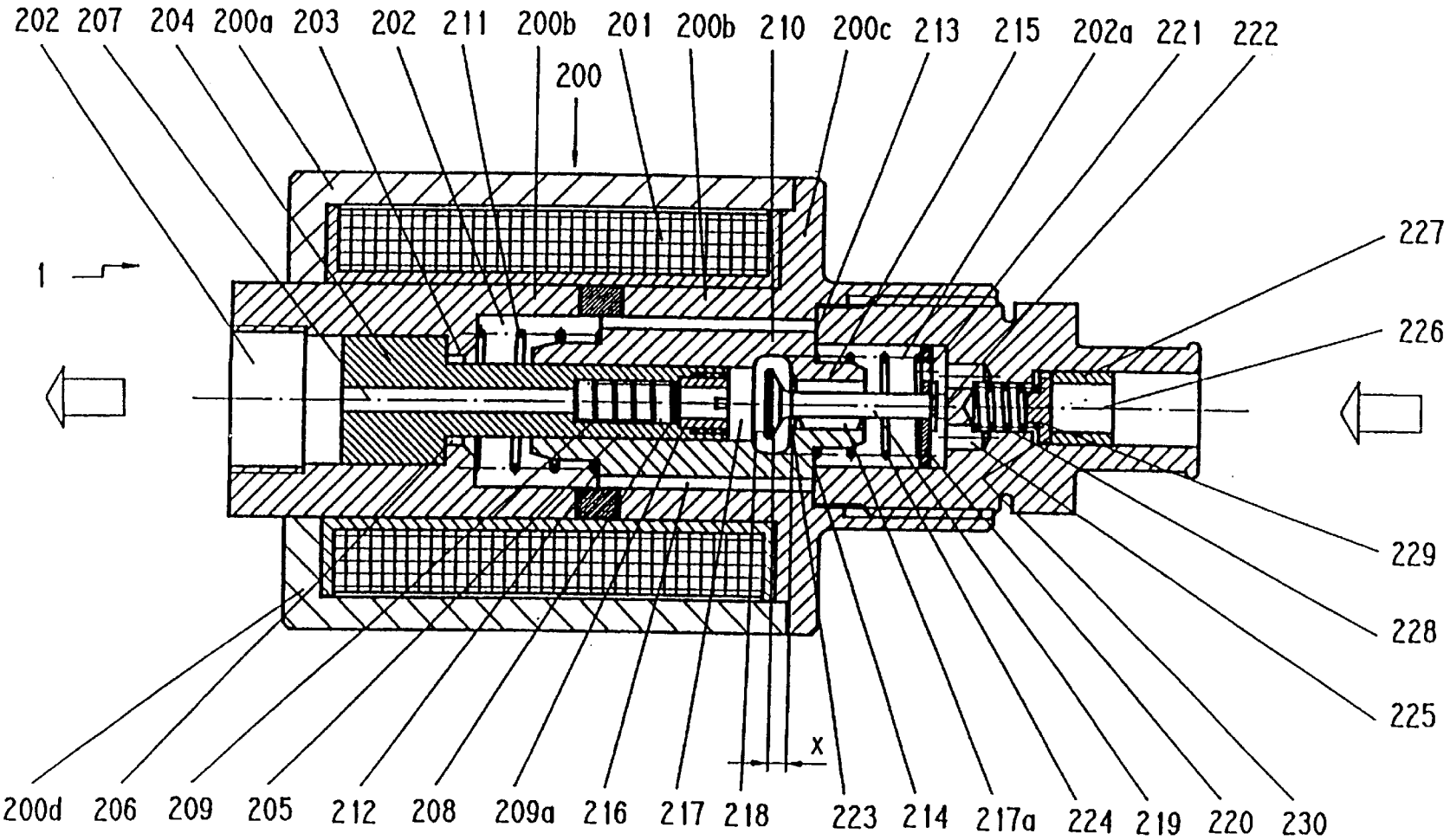

FIG. 13 also shows a compact configuration of the electrically operated plunger pump in accordance with the invention including an integrated stopper valve. In this arrangement a solenoid 201 is disposed in a cylindrical multi-part housing 200 in an interior space 202 defined by an outer shell 200*a* and a cylindrical inner shell 200*b* as well as by a face wall 200*c* on the tank side and a face wall 200*d* on the pressure conduit side. The cylindrical inner space 202 of the housing 200 surrounded by the inner shell 200*b* is divided into a tank-side and a pressure conduit-side inner space portion. On the pressure conduit side a ring bead 204 of a plunger 205 is set against the annular opening of the ring 203, said ring bead being firmly seated with positive contact in said inner space and the plunger 205 spacingly passing through the annular opening 206 of the ring 203 and protruding into the tank-side portion of the inner space 202. The plunger 205 has passing through it full length a drilled passage 207 which is configured flared in the tank-side region of the plunger where it mounts a valve 208 which is urged by a coil spring 209 in the direction of the tank side for the closing position against a valve seat 209*a* and which due to the effect of a pressure acting from the tank side can be opened.

Slidingly seated on the portion of the plunger 205 located in the tank side inner space region of the inner space 202 is a barrel 210 of the plunger pump in positive contact therewith which is urged by a coil spring 211 supported at its one end by the ring 203 and, at the other, by a ring-shaped ridge 212 of the barrel 210 by its tank-side ring end face 214 against a ring-shaped ridge 213 in the inner space 202, a valve port 215 projecting past the end face 214 protruding in radial spacing therefrom partly into the inner space 202*a* radially constricted in this region and the ring end face of the barrel 210 on the pressure conduit side being disposed spaced away from the ring 203, thereby creating room for movement of the barrel 210. The barrel 210 guidingly seated by positive contact with the inner wall of the inner space 202 includes an axial-parallel arrangement of longitudinal grooves 216 open at the end face in the shell surface, the function of which will be subsequently explained further below.

The bore 217 passing through the barrel 210 full-length and receiving the plunger 205 mounts on the tank side a tappet valve located upstream of the plunger 205, the tappet plate 218 of which is disposed spacingly away from the ring end face of the plunger 205 in a short flared bore portion and the push rod 219 of which passes through the constricted passage 217*a* in the valve plate 215, supported by the inner wall of the passage 217*a* and protrudes into the constricted inner space 202*a*.

Expediently at the free end of the push rod 219 a plate 220 is secured which includes holes 221, the function of which is explained further on, the push rod 219 protruding somewhat past the plate 220 and coming up against the tank-side bottom face 222 of the inner space 202*a*. In this arrangement the push rod 219 is selected sufficiently long so that the tappet plate 218 is lifted from its valve seat, the pressure conduit-side orifice 223 of the constricted passage 217*a*, so that a specific gap "X" is formed, the sense and purpose of which is explained further on. A coil spring 224 stabilizes this position of the tappet valve in the depicted resting position of the plunger pump in which the spring 224 is supported at its one end by the ring face end 214 of the barrel 210 and, at its other end, by the plate 220.

From the bottom surface 222 axial-parallel drilled passages 225 extend in the bottom wall and port into an axial valve space 226 in which a valve plate 229 urged by a coil spring 228 in the tank direction against a valve seat 227 is arranged which includes grooves 230 coverable peripherally by the valve seat 227 so that the valve can be opened by a pressure on the tank connecting side against the loading of the spring 228, creating a through-passage from the valve space 226 to the drilled passages 225.

The valve space 226 is in connection with a fuel conduit (not shown) leading to the fuel tank; on the pressure conduit side of the face wall 200*d* and at an extended port of the inner wall 200*b* respectively a pressure conduit is applied (not shown) which leads to the ejection valve. The arrows marked in FIG. 13 indicate the path of the fuel.

The plunger pump depicted in FIG. 13 functions as follows. Due to energization of the solenoid 201 the barrel 210 is accelerated from the illustrated rest position in the direction of the pressure conduit with practically zero resistance, fuel flowing off from the space 202 via the grooves 216 and from the bore 217 and from the tappet plate space respectively in the direction of the inner space 202*a*. This accelerated movement is abruptly ended by the valve seat 223 coming up against the valve plate 218 so that the stored energy of the barrel 210 is translated to the fuel present in the space upstream of the tappet. The valve 208 is opened and the pressure is propagated to the fuel present in the drilled passage 207 and the pressure conduit respectively, as a result of which fuel ejection follows by the injection nozzle. If the energization is then still to be switched off, fuel is ejected as long as the barrel is moved. The tappet valve 218, 219 is thereby coupled into the movement of the barrel 210 and a vacuum materializes in the inner spaces 202, 202*a* and in the drilled passages 225 and the space upstream of the valve space 226 defined by the valve 229 so that the valve 229 is opened. The fuel flows, coming from the tank, through the peripheral grooves 230 in the valve plate 229, the space upstream of the valve space 226, the drilled passages 225 and the holes 221 in the plate 220 into the inner space 202*a* as well as via the grooves 216 into the inner space 202. On energization OFF the barrel is urged back into its resting or starting position by the spring 211, the push rod 219 having abutted against the bottom wall 222 and the tappet valve being opened so that fuel is able to flow through the intermediate space between the push rod and the passage 217*a* into the space 217 upstream of the tappet plate. The valve 208 thereby remains closed, it acting as a standing pressure valve by maintaining in the space between the injection valve (not shown) and the valve plate 208 filled with fuel a standing pressure in the fuel which is e.g. higher than the vapor pressure of the fluid at the maximum temperature occuring so that the formation of bubbles can be avoided.

Figure 14:
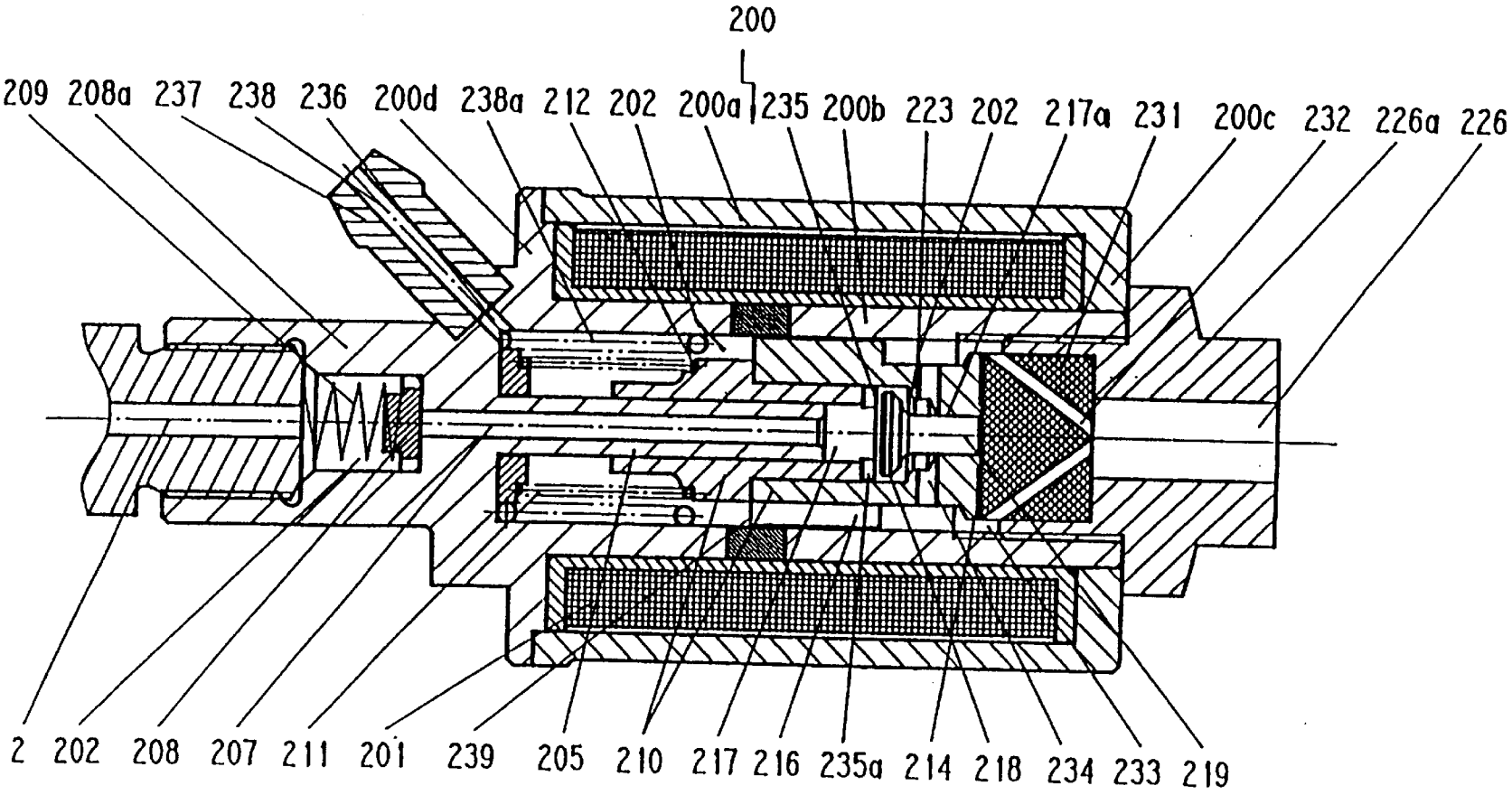

In the embodiment of the injection pump illustrated in FIG. 14 which is the same as the embodiment in FIG. 13, this being the reason why like parts are identified by the same reference numbers, the plunger 205 is configured integral with the face wall 200*d* and the standing pressure valve 208. 209 accommodated in a tube socket 208*a* covers the pressure conduit-side port of the drilled passage 207 passing through the plunger 205.

The sliding pump barrel 210 acting as the armature is configured multi-part as a simple means of fitting the valve tappet 218, 219. Since this multi-part configuration is not substantial to the invention, the configuration of the barrel 210 will not be described in more detail.

The push rod 219 is configured relatively short and may protrude from the tank-side ring face end 214 of the barrel 210 merely by the amount of valve clearance. In the region of the face wall 200*c* the ring face end 214 abuts against a plastics block 231 located there, which includes full-length drilled passages 232 porting peripherally in grooves 233 connecting the inner space 202, whereby drilled passages 234 lead from the tank-side inner space 202 to the flared portion of the bore 217 in the barrel 210. The drilled passages 232 port the axial valve space 226 leading to the tank, this valve space being accommodated in a tubular socket 226*a*.

In this embodiment of the invention the tappet valve 218, 219 is not spring-loaded, it functioning due to the inertial forces, whereby the push rod is seated more or less with positive contact in the constricted drilled passage 217*a*. In the position illustrated in FIG. 14 the tappet valve is urged against the plastics block 231 by the pressure prevalent in the spaces 202, 217 acting on the tappet plate 218. When the barrel 210 is accelerated the tappet valve remains in this position until it is coupled into the movement of the valve seat 223. In the return movement of the armature barrel 210 the push rod 219 abuts against the plastics block 231 so that the tappet valve reattains its starting position as illustrated.

Expediently the flared portion of the bore 217 in which the tappet plate 218 is received forms on the pressure conduit side a ring-shaped ridge 235 which in the resting position of the tappet valve is located merely slightly spaced away upstream of the tappet plate 218 and against which the tappet plate 218 abuts when the tappet due to inertia on the return movement of the barrel 210 lifts off from the valve seat and/or the valve is to be impacted back by the plastics block 231 on return movement of the barrel 210. In the end face of the ring-shaped ridge 235 recesses 235*a* are provided which ensure an unobstructed thru-flow of the fuel. In this way the resting position of the tappet valve is assured by simple means.

During the acceleration of the armature barrel 210 in this embodiment of the injection pump fuel flows from inner space 202 on the pressure conduit side via the grooves 216 into the inner space 202 on the tank side as well as from the drilled passages 207, 217 through the recesses 235*a* bypassing the tappet plate 218 through the opening in the valve seat into the drilled passages 235 also in the inner space 202 on the tank side. The displacement of the fuel is suddenly discontinued by the closing of the tappet valve 218, 219, as a result of which the intended pressure surge is effected. In return movement of the armature barrel 210 the tappet valve 218, 219 opens and the fuel flows in the opposite direction.

Figure 15:
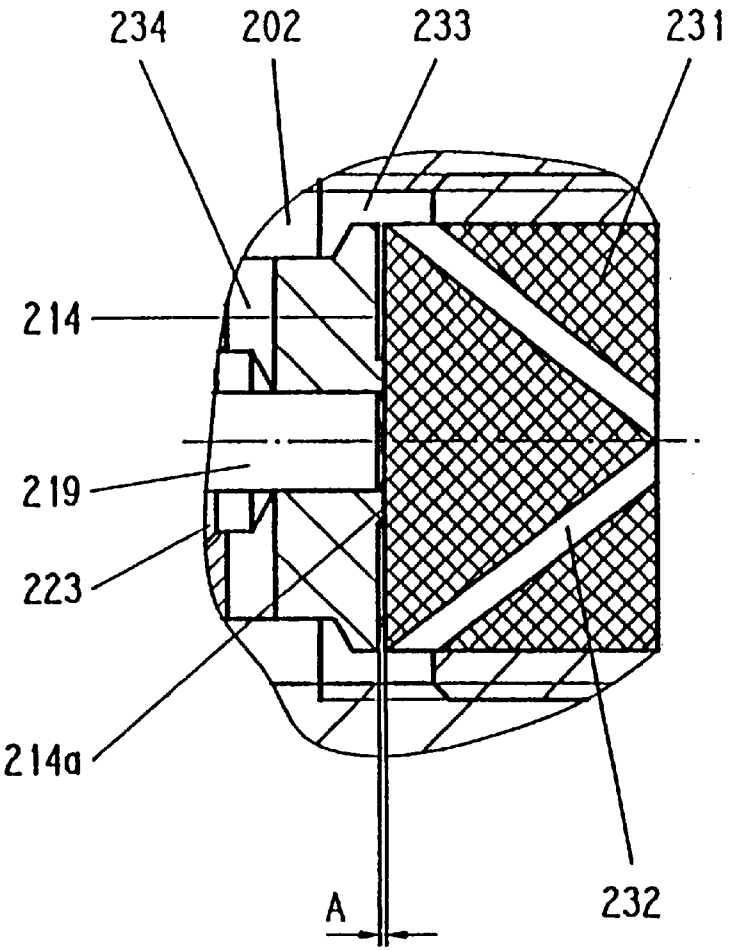

So that the starting movement of the armature barrel 210 from its resting position cannot be detrimented it is expediently provided for that the ring face end 214 is disposed at a slight distance "A" away from the surface of the plastics block 231 (FIG. 15). Supporting lands 214*a* protruding from the ring face end 214 contact the surface of the plastics block 231 and ensure the spacing "A" so that no unwanted vacuum effect can occur at the start of the armature barrel 210 between the ring face end 214 and the surface of the plastics block 231. Such supporting lands may also be arranged for the same purpose on the end face of the push rod 219 (not shown). In addition, the spacing "A" is selected so small that on the return stroke a damping effect materializes by fuel being squeezed out of the gap "A".

Figure 16:
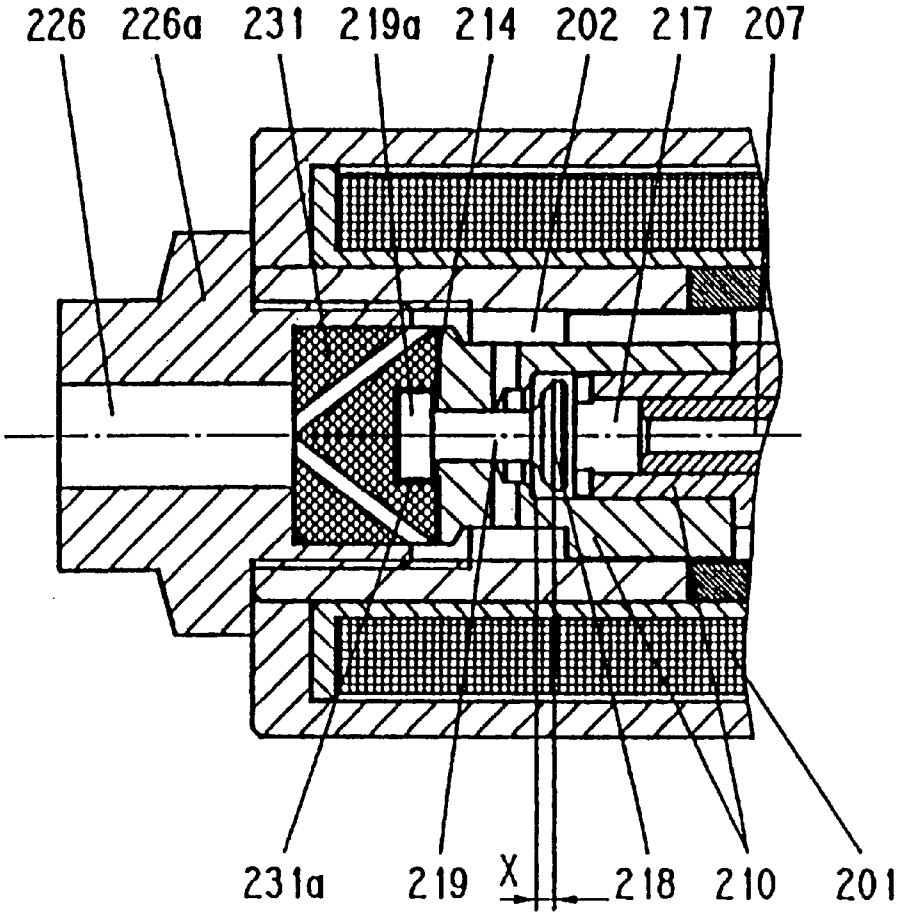

The embodiment of the plunger pump of FIGS. 14 and 15 may be provided with an effective armature damping means of simple configuration as illustrated in FIG. 16. In this arrangement the push rod 219 comprises in its free end portion a flange ring 219*a* which clasps the ring face end 214 somewhat on the side and may adjoin the ring face end 214. In the surface of the plastics block 231 a recess 231*a* corresponding to the flange ring 219*a* is incorporated, into which the flange ring 219*a* fits with more or less positive contact so that a hydraulic damping means as a kind of plunger barrel is formed. On return movement of the armature barrel 210 the flange ring 219*a* and its attachments is coupled into the movement by the ring face end 214. As soon as the flange ring 219*a* plunges into the recess 231*a* fuel is displaced therefrom, causing a deceleration of the armature barrel 210. In acceleration of the armature barrel 210 the armature barrel moves with practically zero resistance. The flange ring 219*a* and thus the tappet valve 218, 219 initially remain in the recess 231*a* until the tappet valve is coupled into the movement by the valve seat.

Expediently the thickness of the flange ring 219*a* is engineered to be slightly more than the depth of the recess 231*a* so that the ring face end 214 remains spaced away from the surface of the plastics block 231 in the resting position of the armature barrel 210 and supporting lands as such are not needed.

Provided expediently in the wall face 200*d* on the pressure conduit side is a drilled passage 236 which leads outwardly from the inner space 202 on the pressure conduit side and on which a socket 237 having a full-length drilled passage 238 is placed on the outside. Through the drilled passage 236 and the bleed port 237 fuel is able to be pumped off from the armature barrel 210 e.g. during the starting phase of the pump and burner respectively so that the pump and/or the fuel feed conduit can be bled of air bubbles. Through the bleed 236, 237 fuel may also, however, be circulated during the injection action so as to carry off heat, as well as to avoid bubbles forming.

Expediently arranged on the inner wall of the inner space 202 on the pressure conduit side is a compression spring 238 supported by the face wall 200*b*, a ring face end 239 of the armature barrel 210 abutting against this spring on acceleration of the armature barrel not before a large stroke for a large amount of fuel to be injected has been initiated, the spring being thereby compressed. On return movement of the armature barrel 210 the spring 238 releases its stored spring force to the armature barrel 210, resulting in the latter being moved correspondingly accelerated into the resting position.

Figure 17:
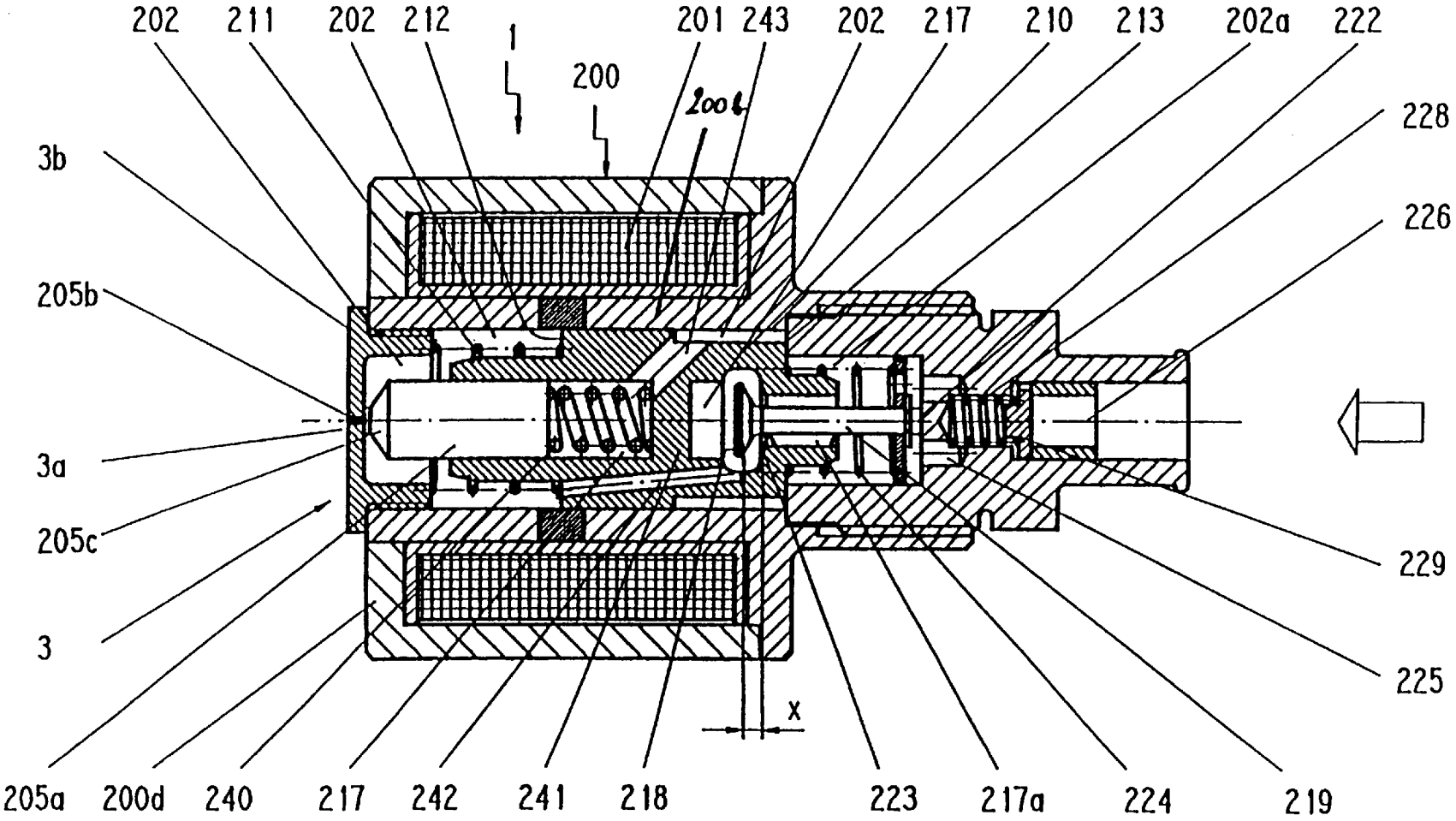

In the plunger pumps described in the following with reference to FIGS. 17, 18, 19 the barrel 210 acts as a plunger-like armature element which is guided fluid-tight in the inner cylinder 200*b*.

An injection pump 1 having similarity to the injection pump depicted in FIG. 13 is illustrated in FIG. 17, like parts again being documented by like reference numerals.

The plunger 205*a* seated partly in the armature barrel bore 217 is not secured to the wall face 200*d* on the pressure conduit side, it instead being mounted for axial movement as part of the ejection valve means 3. The injection valve 3 features a valve cap 3*b* which is screwed into the wall face 220*d* of the housing 200 entering the inner space 202 on the injection valve side. The valve cap includes centrally an injection nozzle drilled passage 3*d*. In its resting position the plunger 205*a* covers the injection nozzle drilled passage 3*d* by an end face 205*b* of reduced diameter. The face 205*b* of reduced diameter translates by a truncated cone 205*c* into the cylindrical portion of the plunger 205*a*. The plunger 205*a* is urged into the armature barrel bore 217 by a compression spring 240 against the injection nozzle drilled passage 3*d*, the compression spring 240 being supported at the other end by an intermediate wall 241 arranged in the armature barrel bore 217, this intermediate wall dividing the bore 217 into a injection nozzle side portion and a tank side portion. In this arrangement at least one drilled passage 242 leads from the ring face end 212 through the armature barrel 210 into the flared cylindrical bore space of the tank side portion of the bore 217, in which the tappet plate 218 is accommodated, and a drilled passage 243 passes through the armature barrel 210 from the injection nozzle side portion of the bore 217 into the tank side inner space 202, the middle portion of the armature barrel 210 being seated with positive contact and practically fluid-tight on the inner wall of the inner space 202. Preferably the armature barrel comprises in the tank side portion of the inner space 202 grooves, the lands of which adjoin the inner wall of the inner space 202 where they form guides for the armature barrel 210.

The injection pump in FIG. 17 functions as follows. When the armature barrel 210 is accelerated from the resting position shown, at first with zero resistance, fuel flows via the drilled passage 242 into the tank-side space of the bore 217 and from there into the space 202*a*, valve 229 remaining closed. In addition, fuel flows through the drilled passage 243 from the space on the injection valve side of the bore 217 into the inner space 202 on the tank side and from there—due to the armature barrel 210 having lifted off the ring face end 213—through the thereby resulting gap also into the space 202*a*. As soon as the tappet valve 218, 219 is seized by the valve seat, the desired surge in pressure materializes in the inner space 202 on the injection valve side. This pressure surge is translated to the conical surface of the truncated cone 205*c* and lifts the plunger 205 against the pressure of the spring 240 from the nozzle 3*a*, so that fuel is ejected. At the same time a vacuum materializes in the space 202*a* and in the inner space 202 on the tank side, this vacuum also acting on the plunger 205, it however being very much less than the force of the spring 240, so that the plunger remains unaffected thereby. This vacuum opens the valve 229, however, so that fuel can be replenished. Valve 229 recloses due to the force exterted by the spring 228 when the return movement of the armature barrel 210 commences so that then due to the movement of the armature barrel fuel is urged into the spaces of the bore 217 and inner space 202. The function of valve 292 corresponds to the function of the same valve 229 in the embodiment of the injection pump 1 in FIG. 13.

Figure 18:
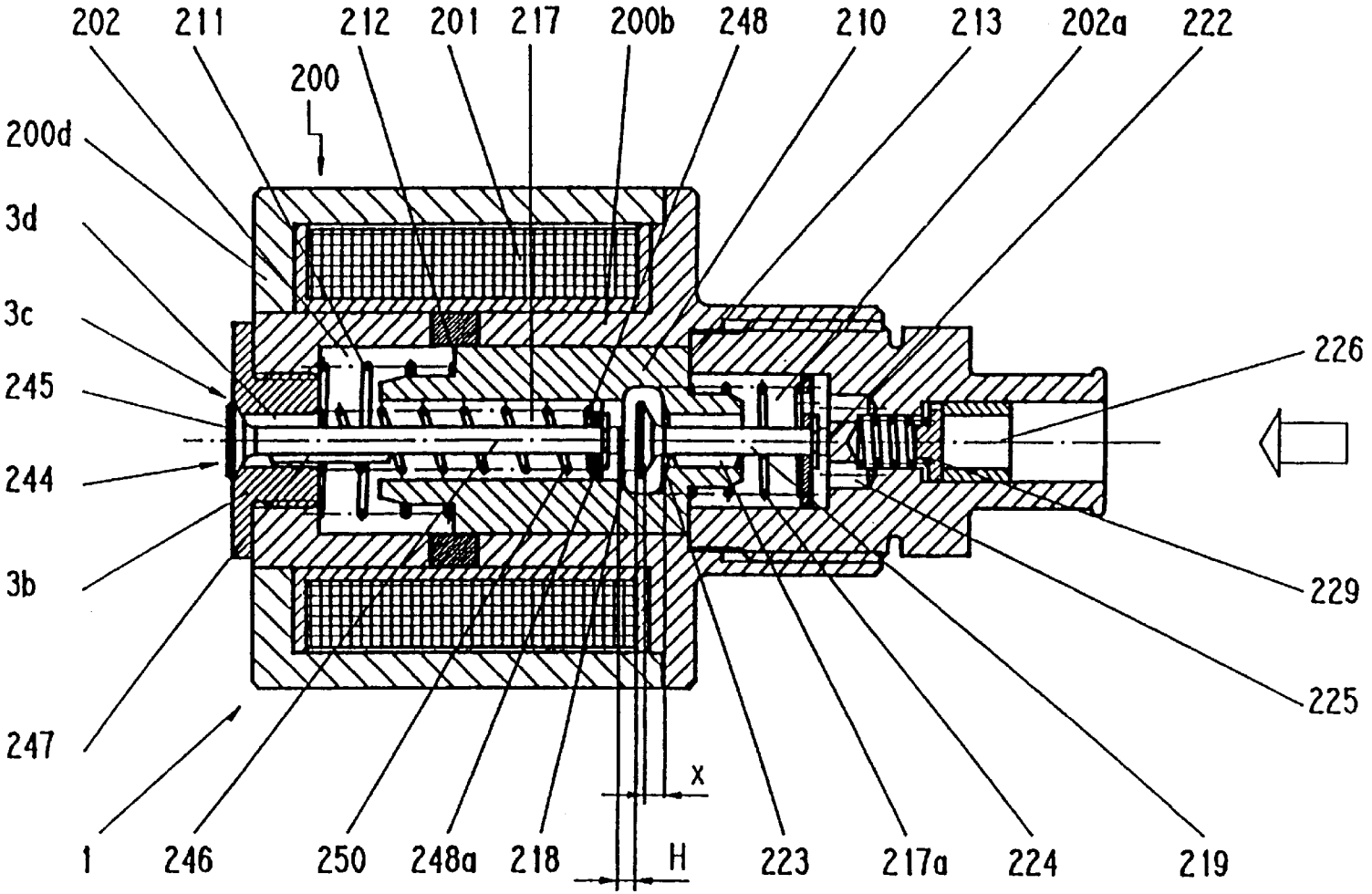
Figure 19:
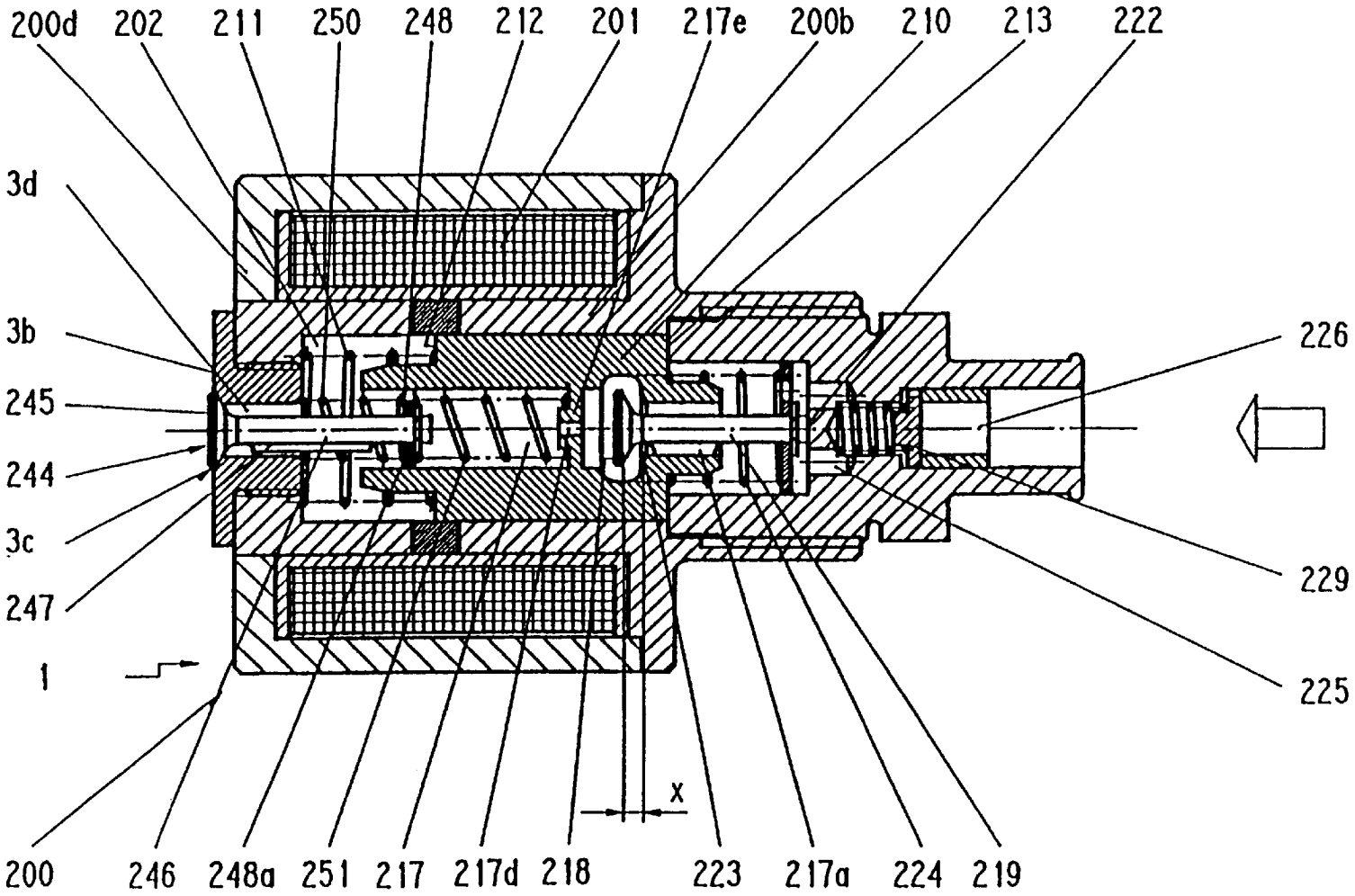

A further embodiment of the injection pump 1 according to the invention in which the injection nozzle 3 is accommodated directly in the wall face 200*d* in the housing 200 of the injection pump 1 is evident from FIG. 18. This embodiment is similar to that of FIG. 17, this being the reason why again like parts are identified by the same reference numerals.

The valve cap 3*b* forms in this case a valve seat 3*c* for a tappet valve 244, the valve plate 245 of which is drawn from without against the valve seat 3*c* and the push rod 246 of which passes through the cap passage 3*d* downstream of the valve seat 3*c* freely or radially supported by ribs 247 and passes freely through the armature barrel bore 217 and ends shortly ahead of the flared region of the bore 217 in which the tappet plate 218 of the tappet valve 218, 219 is received, at the free end of said push rod 246 a ring 248*a* including holes or radial recesses 248 being secured, against which a compression spring 250 is supported on the injection valve side, this spring being in contact at the other end with the face wall 200*d* of the housing 200 and the valve cap 3*b* respectively, the armature barrel 210 having merely the full-length bore 217 and no radial grooves, it being instead in positive, fluid-tight contact with the inner wall of the inner space 202.

This injection pump, comprising no plunger, functions unlike the embodiment of FIG. 17 as follows. When the tappet valve 218, 219 is coupled into the movement of the valve seat of the armature barrel 210, the sudden increase in pressure occurs in the fuel in the space 202, 217 and 3*d* so that the tappet valve 244 opens against the pressure of the return spring 250 for ejection. Subsequently, the tappet plate 218, following a further stroke travel "H", comes up against the push rod 246 and holds the valve 244 open.

An embodiment of the injection pump 1 according to the invention similar to the embodiment illustrated in FIG. 18 is depicted in FIG. 19, here again like parts being identified by like reference numerals.

The push rod 246 of the tappet valve 244 is engineered shorter and extends in the resting position or starting position of the pump 1 only up to the end portion of the armature barrel bore 217 on the injection valve side, the return spring 250 being engineered accordingly shorter. In addition, however, a further compression spring 251 urges the ring 248*a* from the tank side, this spring being supported at one end by a wall 217*e* comprising a central bore 217*d*, this wall dividing the bore 217 into a injection valve side portion and a tank side portion, connected via the bore 217*d*.

In this version of the injection pump 1 the spring 251 supports jerking open the valve 244, the same as in the case of the embodiment according to FIG. 18 in which jerking open is supported by the valve plate 218 impacting the push rod 246. In this case, the springs then hold also the valve 244 in the open position as long as this is effected by the pressure of the spring 250 and 251 respectively.

Figure 20:
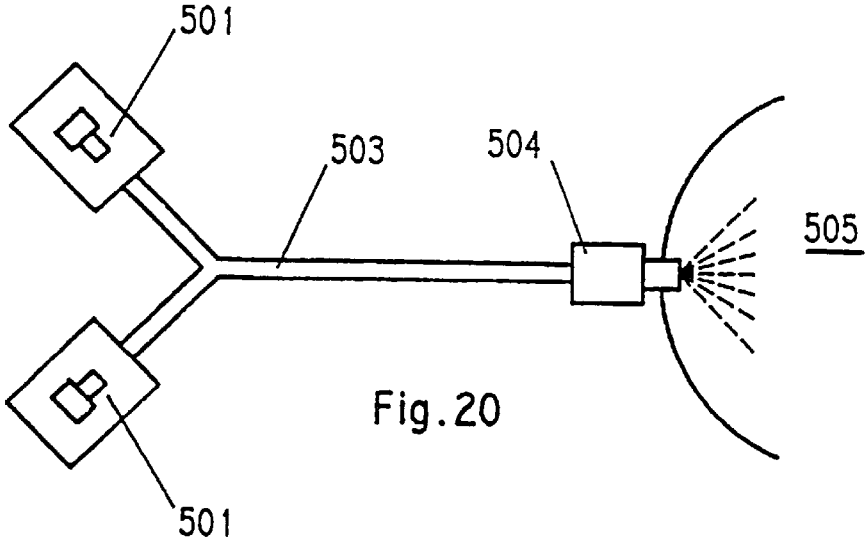
FIG. 20 shows an injection device having two pumps and a single nozzle.

To boost the thruput, which in the case of large burners is in the range of roughly 100 kg/h to 900 kg/h, it is expedient to provide an injection device with several pumps 501 (FIG. 20) which inject the fuel through the nozzle or the valve 504 into the combustion chamber via a common delivery conduit 503. The individual pumps are preferably operated out of phase so that the fuel bursts are injected at a very frequency into the combustion chamber 505. When employing a greater number of pumps a quasi-continuous fuel feed can then be achieved via a single nozzle 504, the thruput of which can be controlled much more accurately, however, as compared to conventional continuously operating fuel feeding means.

Figure 21:
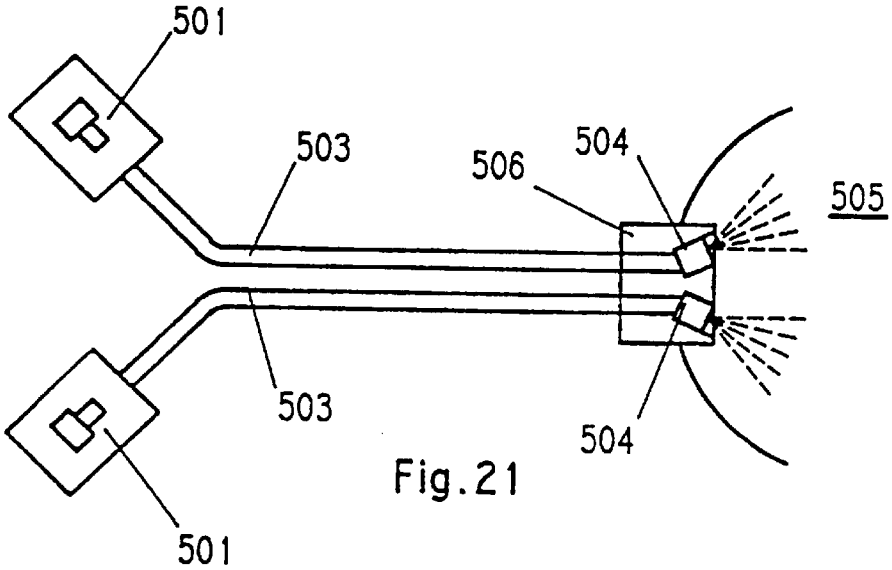
FIG. 21 shows an injection device consisting of several pumps and nozzles porting in a single nozzle bank.
Figure 22:
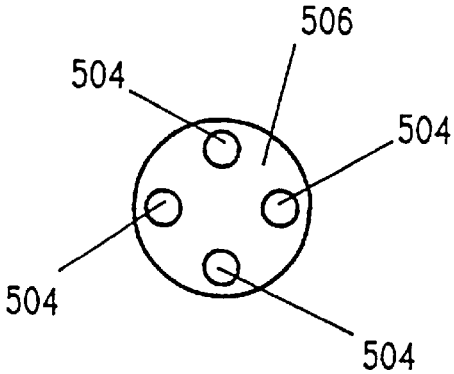
FIG. 22 shows the nozzle bank as viewed from the interior of the combustion chamber and FIG. 23 is a schematic representation of an injection device according to the energy-storage principle which makes use of the energy stored in the fluid.
Figure 23:
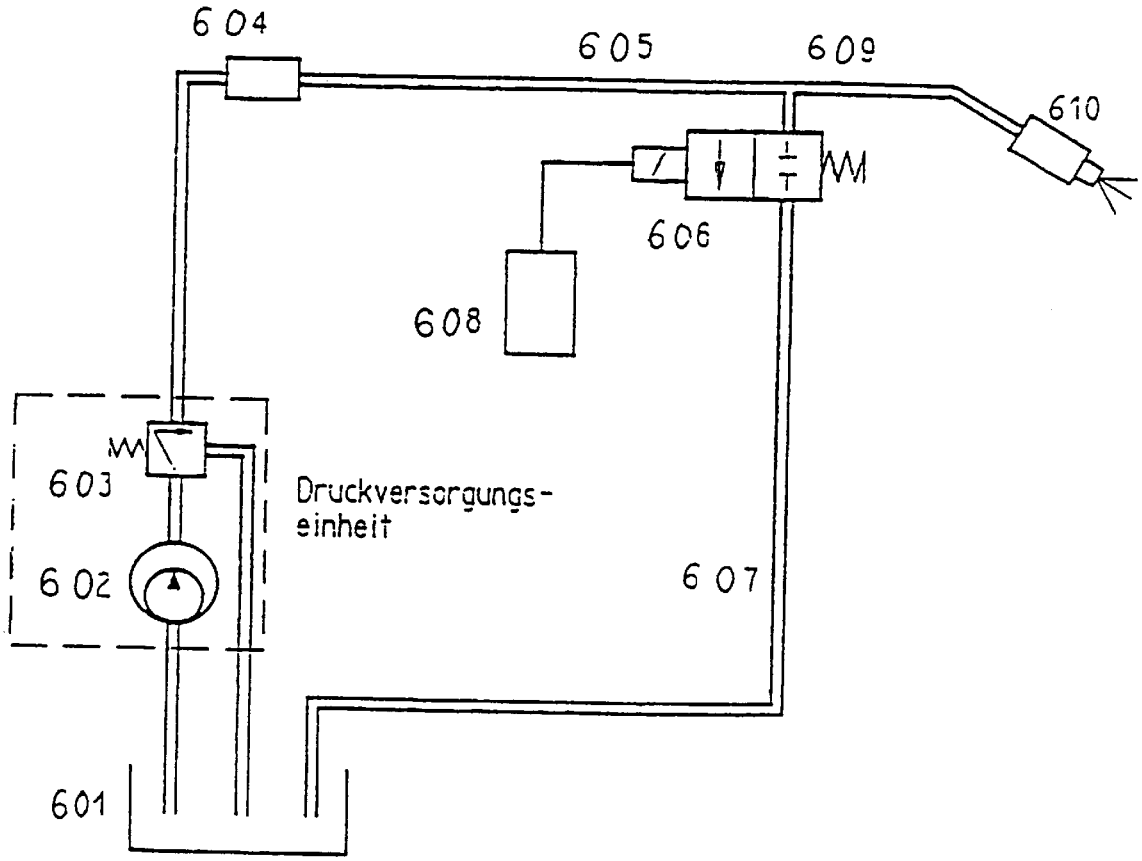

It is also possible to connect several pump/nozzle units via a common nozzle bank 506 (FIGS. 21, 22). In such a nozzle bank 506 a separate nozzle insert 504 is provided for each pump 501. The pumps 501 may output their bursts circulatingly so that the individual fuel bursts are output to the nozzle inserts 504 in circulation in the combustion chamber 505, as a result of which the flame center in the burner executes a circular movement. This in turn clearly demonstrates that by means of the device according to the invention influence on parameters can be made to which no access was available in the case of conventional burner controls.

The field of application of the burners according to the invention includes both large and small capacity burners as used for heating, drying, evaporating, driving gas turbines etc. and featuring an intensive heat output, the excellent atomization of the fuel in the combustion chamber also created by the high pressure (50 to 100 bar) enabling the configuration of the device to be maintained compact and achieving excellent emission values.

We claim:

1. An oil burner for a heating system including a combustion chamber into which fuel is fed by a fuel feed element characterized in that said fuel feed element is an injection device operating on the principle of energy storage comprising a pump (1) and a nozzle device (3) operatively associated with the pump, and the pump is operative to displace a partial quantity of fuel during a substantial zero-resistance acceleration phase during which the pump stores kinetic energy prior to injecting fuel to the combustion chamber, followed by an abrupt halting of the substantially zero-resistance acceleration so that the stored kinetic energy imparts a sudden pressure surge to the fuel supplied to the nozzle device, whereby the nozzle device delivers bursts of fuel in specified quantities.

2. The oil burner as set forth in claim 1, characterized in that said injection device is configured such that the volume of fuel ejected per injection pulse is adjustable.

3. The oil burner as set forth in claim 1, characterized in that said injection device is connected to a control unit which controls the injection frequency such that it exhibits a frequency spacing from the resonance frequency of said combustion chamber which is as large as possible.

4. An oil burner for a heating system including a combustion chamber into which fuel is fed by a fuel feed element, characterized in that said fuel feed element is an injection device operating on the principle of energy storage comprising a pump (1) and a nozzle device (3) which delivers bursts of fuel in specified quantities, and including an electronic control unit having a gas sensor for sensing the resulting combustion gases which regulates at least one of the frequency of injection and the injection quantity as dictated by the signal of said gas sensor.

5. An oil burner for a heating system including a combustion chamber into which fuel is fed by a fuel feed element, characterized in that said fuel feed element is an injection device operating on the principle of energy storage comprising a pump (1) and a nozzle device (3) which delivers bursts of fuel in specified quantities, and including several pumps (501) which are connected via a common delivery conduit (503) to a single nozzle (504).

6. An oil burner for a heating system including a combustion chamber into which fuel is fed by a fuel feed element, characterized in that said fuel feed element is an injection device operating on the principle of energy storage comprising a pump (1) and a nozzle device (3) which delivers bursts of fuel in specified quantities, and including several pumps (501) each of which is connected via a delivery conduit (503) to a separate nozzle (504) arranged in a single nozzle bank (506).

7. An oil burner for a heating system including a combustion chamber into which fuel is fed by a fuel feed element, characterized in that said fuel feed element is an injection device operating on the principle of energy storage comprising a pump (1) and a nozzle device (3) which delivers bursts of fuel in specified quantities, and further characterized in that a plunger element guided in a barrel of a solenoid-driven plunger pump displaces partial quantities of the fuel to be ejected during an acceleration phase of practically zero resistance whilst said plunger element stores kinetic energy, prior to ejection in the pump region, said displacement being abruptly halted by means interrupting displacement, so that a pressure surge is generated in the fuel present in a enclosed pressure space by the stored kinetic energy of said plunger element being directly translated to the fuel present in said pressure space and said pressure surge being used to eject the fuel through an injection nozzle device.

8. The oil burner as set forth in claim 7, characterized in that said means generating said pressure surge interrupting displacement are arranged outside of the guiding fluid-tight contact portion between said plunger element and said plunger barrel of said plunger pump.

9. The oil burner as set forth in claim 7, characterized in that said means for interrupting displacement is configured as a means (6, 50, 70, 90, 125, 218/223) including a stopper means.

10. The oil burner as set forth in claim 9, characterized in that said stopper means is operatively associated with the enclosed pressure space to selectably vary said space.

11. The oil burner as set forth in claim 7, characterized in that for the displacement of fuel during said acceleration phase a volume storage element (6) is provided.

12. The oil burner as set forth in claim 11, characterized in that a tank-side hydraulic valve together with said pump (1) and said pressure conduit (2) are accommodated in a common housing (121) and is a hydraulically controlled fuel feed valve (122) seated in said fuel feed conduit which closes automatically due to the Bernoulli effect at a specific flow velocity.

13. The oil burner as set forth in claim 12, characterized in that the fuel gains access via a gap (123) to a valve space (124) of said valve (122) in which between a valve cone (125) and the associated valve seat a narrow ring gap remains which is selectably variable by a spring (126) loading said valve cone (125).

14. The oil burner as set forth in claim 12, characterized in that said pressure conduit (2) leading to said injection nozzle is connected to the output of a check valve (127) which is likewise integrated in said body (121) and via which the fuel path leads to said injection nozzle (3).

15. The oil burner as set forth in claim 14, characterized in that said check valve (127) includes a valve cone (128) which is urged by the preloading of a spring (129) against an associated valve seat, said spring (129) being designed so that said valve (127) is closed when the pressure applied in the direction of said pressure conduit (2) is below the value resulting in fuel being emitted via said injection nozzle (3) connected directly to said valve (127).

16. The oil burner as set forth in claim 11, characterized in that said storage element (6) comprises a housing (22) in the cavity space of which a diaphragm (23) as the displacement member is clamped which separates from said cavity space a space filled with fuel on the pressure conduit side and which in the relaxed condition divides said cavity space into two halves sealed off from each other by said diaphragm, a vacant space being arranged at the side of the diaphragm facing away from said conduit (7) which includes an arched wall (22*a*) as a stopper means for said diaphragm (23).

17. The oil burner as set forth in claim 11, characterized in that said storage element (6) is configured integrally with said delivery plunger (14) of said plunger pump (1).

18. The oil burner as set forth in claim 17, characterized in that said storage element comprises a storage plunger (80) which is urged in a first section (14*b*) of a longitudinal center ridged drilled passage on the pressure conduit side of a ridged drilled passage (14*a*) passing centrally through said plunger (14) and said armature (10) being urged against a stopper on the pressure conduit side by a spring (81), said plunger (80) protruding in its resting position by its one end face into the pressure space (15) and the drilled passage section (14*b*) receiving said storage plunger (80) in said delivery plunger (14) being continued downstream of a ridge (14*c*) towards said armature (10) in a further ridged drilled passage section (14*d*) on the ridge (14*e*) of which a compression spring (81) is supported which urges against the armature-side end face of said plunger (80).

19. The oil burner as set forth in claim 11, characterized in that it comprises an solenoid-driven plunger pump (1) which is connected via a delivery conduit (2) to an injection nozzle device (3), from said delivery conduit (2) an intake conduit (4) branching off which is in connection with a fuel storage tank (5) and whereby said volume storage element (6) is connected to said delivery conduit (2) via a conduit (7).

20. The oil burner as set forth in claim 19, characterized in that a check valve (16) is disposed in said intake conduit (4).

21. The oil burner as set forth in claim 19, characterized in that in said pressure conduit (2) between said injection valve (3) and said pressure space upstream of said branches (4, 7) a check valve (16*a*) is disposed which in said space on the injection valve side forms an accumulation space for maintaining a specific standing pressure in the fuel.

22. The oil burner as set forth in claim 19, characterized in that as the displacement member for said storage element (6) a storage plunger (31) guided-in a cylindrical housing (30) connecting said conduit (7) is employed, said cylinder (3) providing a vacant volume (33*c*) into which said plunger (31) is displacable by the fuel.

23. The oil burner as set forth in claim 22, characterized in that in the region of said vacant space volume (33*c*) a drain passage (32) is arranged.

24. The oil burner as set forth in claim 18, characterized in that in said vacant space volume (33*c*) a compression spring (34) is clamped in place which urges said plunger (31) into its resting position against a housing wall (33*a*) on the pressure conduit side.

25. The oil burner as set forth in claim 22, characterized in that in said vacant space volume (33*c*) an axially adjustable stopper pin (37) for said plunger (31) is arranged which passes through said housing wall and is in contact with an adjuster means outside of said housing.

26. The oil burner as set forth in claim 12, characterized in that said pump (1) comprises a housing (8) in which a ring solenoid (9) is mounted, an armature (10) being arranged in the region of the solenoid passage which is configured as a cylindrical body and guided by a housing cylinder which is located in the region of the longitudinal middle axis of said ring solenoid (9) and is urged by means of a compression spring (12) into a starting position in which it is in contact with the bottom (11*a*) of said housing cylinder, a delivery plunger (14) being applied to the end face on the injection nozzle side of said armature (10), said plunger plunging relatively deeply into a cylindrical fuel delivery space (15) arranged coaxial to said housing cylinder and connecting said pressure conduit (2) translatingly.

27. The oil burner as set forth in claim 26, characterized by a hydraulic damping means for said armature element (10) of said plunger pump.

28. The oil burner as set forth in claim 27, characterized in that said hydraulic damping means is configured as a kind of plunger/barrel assembly, on said armature (10) a cylindrical protrusion (10*a*) being configured centrally which fits in the last section of the armature return movement in a blind cylindrical hole (11*b*) in the bottom (11*a*) of the barrel, said armature (10) being arranged in grooves (10*b*) oriented longitudinally which connect the space at the rear side of the armature to the space at the front side of the armature in the pump barrel.

29. The oil burner as set forth in claim 27, characterized in that said pump space (11) through which said delivery plunger (14) passes is connected upstream of said plunger (10) to the adjoining space on the rear side of the armature by drilled passages (10*d*) which port in the region of the armature rear side into a central overflow passage (10*c*), a central pin (8*a*) of a shock absorber (8*b*) protruding by its conical tip (8*c*) in the porting direction of said overflow passage (10*c*).

30. The oil burner as set forth in claim 29, characterized in that, said central pin (8*a*) rearwardly passes through a hole (8*d*) in said bottom (11*a*) porting a damping space (8*e*), said pin (8*a*) ending in said damping space by a ring (8*f*) having a larger diameter than that of said hole (8*d*), at the bottom of said damping space a spring (8*g*) being supported which urges said ring (8*f*), a passage (8*h*) connecting said damping space (8*e*) to said rearward armature space (11).

31. The oil burner as set forth in claim 29, characterized in that in said pin (8*a*) a full-length central displacement passage (8*i*) is disposed through which the damping medium is able to be forced into said overflow passage (10*c*).

32. The oil burner as set forth in claim 27, characterized in that said armature (10) on the return movement functions as a pumping means which simultaneously ensures a damping means for said armature (10).

33. The oil burner as set forth in claim 32, characterized in that a second pump (260) is connected to the rearward bottom (11*a*) of said pump housing (8) comprising a housing (261) in the pressure space (261*b*) of which a plunger (262) is arranged, the plunger rod (262*a*) of which protrudes into the working space (11) of said armature (10), said plunger (262) being loaded by a return spring (263) which is supported by the the bottom (261*a*) of the housing in the region of an outlet (264).

34. The oil burner as set forth in claim 33, characterized in that said pump space (261*b*) is connected via a feed conduit (265) to a storage tank (266), a check valve (267) being incorporated in said feed conduit (265).

35. The oil burner as set forth in claim 27, characterized in that said blind cylindrical hole (11*b*) has a larger diameter than the diameter of said cylindrical protrusion (10*a*) and said protrusion (10*a*) or said blind cylindrical hole (11*b*) includes a sealing lip ring (10*e*) and (10*d*) respectively, said sealing lip rings forming the plunger seal for the protrusion (10*a*).

36. The oil burner as set forth in claim 26, characterized in that said armature is configured as the pump barrel (210), the inner space (202) of the body being divided by a ring (203) extending radially inwardly into an inner space portion on the tank side and on the pressure conduit side respectively and whereby on the pressure conduit side a ring bead (204) seated with positive contact and firmly in said inner space of a plunger (205) of said plunger pump (1) is set against a rim of said ring (203), said ring bead passing spacingly through the ring opening (206) of said ring (203) and protruding into the tank side region of said inner-space (202) where it engages a full-length drilled passage (217) of said armature barrel (210).

37. The oil burner as set forth in claim 36, characterized in that seated on the portion of the plunger (205) located in the tank-side inner space region of the inner space (202) is a barrel (210) of the plunger pump in positive contact and slidingly which is urged by a coil spring (211) supported at its one end by the ring (203) and, at the other, by a ring-shaped ridge (212) of the barrel (210) by its tank-side ring end face (214) against a ring-shaped ridge (213) in the inner space (202), a valve port (215) projecting past said ring end face (214) protruding in radial spacing therefrom partly into the inner space (202) radially constricted in this region and said ring end face of said barrel (210) on the pressure conduit side being disposed spaced away from said ring (203), thereby creating room for movement of said barrel (210).

38. The oil burner as set forth in claim 37, characterized in that said barrel (210) guidingly seated by positive contact with the inner wall of said inner space (202) includes an axial-parallel arrangement of longitudinal grooves (216) open at the end face in the shell surface, and that said drilled passage (217) passing through said barrel (210) full-length and receiving said plunger (205) mounts on the tank-side a tappet valve located upstream of said plunger (205), the tappet plate (218) of which is disposed spacingly away from said ring end face of said plunger (205) in a short flared portion of the drilled passage and the push rod (219) of which passes through the constricted drilled passage (217*a*) in the valve port (215) supported by the inner wall of said drilled passage (217*a*) and protrudes into said constricted inner space (202*a*).

39. The oil burner as set forth in claim 38, characterized in that at said free end of said push rod (219) a plate (220) is secured which includes holes (221), said push rod (219) protruding somewhat past said plate (220) and coming up against said tank-side bottom surface (222) of said inner space (202*a*), said push rod (219) being selected sufficiently long so that said tappet plate (218) is lifted from its valve seat (223) of said constricted drilled passage (217*a*), so that a specific gap "X" is formed.

40. The oil burner as set forth in claim 39, characterized in that a coil spring (224) stabilizes the position of said tappet valve in the resting position of said plunger pump in which said spring (224) is supported at its one end by said ring face end (214) of said barrel (210) and, at its other end, by said plate (220).

41. The oil burner as set forth in claim 38, characterized by an armature damping means in the free end portion of said push rod (219), a flange ring (219*a*) being disposed there which clasps said ring face end (214) somewhat on the side and may adjoin said ring face end (214), in said surface of said plastics block (231) a recess (231*a*) corresponding to said flange ring (219*a*) being incorporated into which said flange ring (219*a*) fits with more or less positive contact.

42. The oil burner as set forth in claim 41, characterized in that the thickness of said flange ring (219*a*) is configured slightly greater than the depth of said recess (231*a*).

43. The oil burner as set forth in claim 36 characterized in that from said bottom face (222) axial-parallel drilled passages (225) extend in said bottom wall and port into an axial valve space (226) in which a valve plate (229) urged by a coil spring (228) in the tank direction against a valve seat (227) is arranged which includes grooves (230) coverable peripherally by said valve seat (227) so that said valve can be opened by a pressure on the tank connecting side against the loading of said spring (228), creating a through-passage from said valve space (226) to said drilled passages (225).

44. The oil burner as set forth in claim 36, characterized in that at said inner wall of said inner space (202) on the pressure conduit side a compression spring (238*a*) is supported by said face wall (200*b*), a ring face end (239) of said armature barrel (210) abutting against said spring on acceleration of said armature barrel and thereby compressing said spring.

45. The oil burner as set forth in claim 36, characterized in that said barrel (210) acts as a plunger-like armature element which is guided fluid-tight in said inner space (202).

46. The oil burner as set forth in claim 45, characterized in that said plunger (205*a*) seated partly in said armature barrel bore (217) is mounted for axial movement as part of said ejection valve means (3).

47. The oil burner as set forth in claim 46, characterized in that said ejection valve means (3) features a valve cap (3*b*) which is screwed into said wall face (200*d*) of said housing (200) entering said inner space (202) on the injection valve side, in its resting position said plunger (205*a*) covering said injection nozzle drilled passage (3*d*) by an end face (205*b*) of reduced diameter and said face (205*b*) of reduced diameter translating by a truncated cone (205*a*) into the cylindrical portion of said plunger (205*a*).

48. The oil burner as set forth in claim 47, characterized in that said plunger (205*a*) is urged into said armature barrel bore (217) by a compression spring (240) against said injection nozzle drilled passage (3*d*), said compression spring (240) being supported at the other end by an intermediate wall (241) arranged in said armature barrel bore (217), said intermediate wall dividing said bore (217) into an injection nozzle side portion and a tank side portion.

49. The oil burner as set forth in claim 48, characterized in that at least one drilled passage (242) leads from said ring face end (212) through said armature barrel (210) into said flared cylindrical bore space of said tank end portion of said bore (217), in which said tappet plate (218) is accommodated, and a drilled passage (243) passes through said armature barrel (210) from the injection nozzle side portion of said bore (217) into said tank end inner space (202), said middle portion of said armature barrel (210) being seated with positive contact and practically fluid-tight on said inner wall of said inner space (202).

50. The oil burner as set forth in claim 49, characterized in that said armature barrel (210) comprises in the tank-side portion of said inner space (202) grooves, the lands of which adjoin said inner wall of said inner space (202) where they form guides for said armature barrel (210).

51. The oil burner as set forth in claim 36, characterized in that said plunger (205) has passing through it a full length drilled passage (207) which is configured flared in the tank-side region of the plunger where it mounts a check valve (208) which is urged by a coil spring (209) in the direction of the tank-side for the closing position against a valve seat (209*a*).

52. The oil burner as set forth in claim 36, characterized in that said plunger (205) is configured integral with said face wall (200*d*) of said housing (200), said standing pressure valve (208, 209) being arranged upstream of said plunger (205) on the pressure conduit side accommodated in a tube socket (208*a*) and covers said pressure conduit side port of said drilled passage (207) passing through said plunger (205).

53. The oil burner as set forth in claim 52, characterized in that in said wall face (200*d*) on said pressure conduit side is a drilled passage (234) which leads outwardly from said inner space (202) on the pressure conduit side and on which a socket (237) having a full-length drilled passage (238) is placed on the outside, through said drilled passage (236) and said bleed port (237) fuel being able to be pumped off from said armature barrel (210) during the starting phase of said pump and oil burner respectively or continually.

54. The oil burner as set forth in claim 52, characterized in that said injection nozzle (3) is accommodated directly in the face wall (200*d*) of said housing (200) and comprises a valve cone (3*b*) with a valve seat (3*c*) for a tappet valve (244), the valve plate (245) of which is drawn from without against said valve seat (3*c*) and the push rod (246) of which passes through said cap passage (3*d*) downstream of the valve seat (3*c*) freely or radially supported by ribs (247) and passes freely through the armature barrel bore (217) and ends shortly ahead of the flared region of said bore (217) in which said tappet plate (218) of said tappet valve (218, (219) is received, at the free end of said push rod (246) a ring (248*a*) including holes or radial recesses (248) being secured, against which a compression spring (250) is supported at said injection valve end, this spring being in contact at the other end with the face wall (200*d*) of said housing (200) and said valve cone (3*b*) respectively, said armature barrel (210) having merely the full-length bore (217*a*) and no radial grooves, it being instead in positive, fluid-tight contact with said inner wall of said inner space (202), and said tappet plate (218) abutting against said push rod (246) after a certain stroke travel on the pumping movement.

55. The oil burner as set forth in claim 54, characterized in that said push rod (246) of said tappet valve (244) is engineered shorter and extends in said resting position of said pump (1) only up to said end portion of said armature barrel bore (217) on the injection valve side, in addition, a further compression spring (251) urging said ring (248*a*) from the tank side, this spring being supported at one end by a wall (217*e*) comprising a central drilled passage (217*d*), this wall dividing said bore (217) into an injection valve side portion and a tank side portion, connected via said drilled passage (217*d*).

56. The oil burner as set forth in claim 52, characterized in that said push rod (219) is configured relatively short and may protrude from said tank-side ring face end (214) of said barrel (210) merely by the amount of valve clearance.

57. The oil burner as set forth in claim 56, characterized in that in said region of said face wall (200*c*) said ring face end (214) abuts against a plastics block (231) located there, which includes full-length drilled passages (232) porting peripherally in grooves (233) connecting said tank-side inner space (202), whereby drilled passages (234) lead from said tank-side inner space (202) to said flared portion of said drilled passage (217) in said barrel (210) and said drilled passages (232) port said axial valve space (226) leading to said tank, this valve space being accommodated in a tubular socket (226*a*).

58. The oil burner as set forth in claim 57, characterized in that said flaring of said drilled passage (217) in which said tappet plate (218) is received forms on the pressure conduit side a ring-shaped ridge (235) which in the resting position of said tappet valve is located merely slightly spaced away upstream of said tappet plate (218) and against which said tappet plate (218) abuts when said tappet due to inertia on the return movement of said barrel (210) lifts off from said valve seat and/or said valve is to be impacted back by said plastics block (231) on return movement of said barrel (210).

59. The oil burner as set forth in claim 58, characterized in that in the end face of said ring-shaped ridge (235) recesses (235*a*) are provided which ensure an unobstructed thru-flow of said fuel.

60. The oil burner as set forth in claim 50, characterized in that said ring face end (214) is disposed at a slight distance away from the surface of said plastics block (231).

61. The oil burner as set forth in claim 60, characterized in that protruding supporting lands (214*a*) are arranged on said ring face end (214).

62. The oil burner as set forth in claim 19, characterized in that on the side of said diaphragm (23) facing away from said conduit (7) in said vacant space a spring (24) loading said diaphragm is arranged which acts as the return spring for said diaphragm (23).

63. The oil burner as set forth in claim 7, characterized in that said fuel feed valve (16) is also configured as a storage element valve (50).

64. The oil burner as set forth in claim 63, characterized in that said valve (50) comprises a cylindrical body (51) in which a full-length drilled passage (52) is incorporated, having a pressure conduit side section (53) and a suction side section (53*b*), a radially flared valve space (54) being configured inbetween to receive a shut-off valve element (55) integrally comprising a circular disk (56) of large diameter and a circular disk (57) of small diameter, said circular disk (57) being arranged on the side of the section (53) of the drilled passage and a valve barrel return spring (58) urging said valve element in the resting position against a ring face end (59) of said valve seat (54) on the pressure conduit side, said spring being supported at one end by said circular disk (56) and, at the other, by the bottom of ring-shaped ridge (60) arranged centrally in the end face (61) opposite said end face (59) of said valve space (54) so that said circular disk (56) is able to come into sealing contact with said end face (61) of said valve seat (54) and said drilled passage section (53) being in contact with said valve space (54) via flutes or grooves (62) arranged in said body wall (51) which are expediently flared funnel-shaped in the direction of said valve space (54).

65. The oil burner as set forth in claim 63, wherein the storage element valve comprises a solenoid-controlled valve (70).

66. The oil burner as set forth in claim 65, characterized in that said valve (70) comprises in a valve body (77) a ring solenoid (78) in the inner space of which a cylinder passage (74) is provided in which an armature (73) is guided which is connected to a spring-loaded valve plate (72) and at least one drilled passage (75) extending transversely to the longitudinal extension of said armature in the region of said valve plate, said armature (73) being urged by a spring (76) urged into an end position on the pressure conduit side in which the fuel is in contact with the fuel of said pressure spaces (15, 2) via said drilled passages (75) and (74) and said pressure conduit orifice (71).

67. The oil burner as set forth in claim 63, characterized in that an integral storage element feed valve means (90) comprising a body (91) including a longitudinal center drilled passage (92) porting at one end via an orifice (93*a*) in said pressure conduit (2) and at the other end in a cylindrical valve space (93), flutes (94) in addition leading from said drilled passage (92) to said valve space (93) and said valve element being configured two-part and comprising a cylinder (95) guided in said valve space (93) in the cylindrical full-length central ridged drilled passage of which a plunger (96) is slidingly guided and in the outer shell surface of said cylinder (95) axially parallel grooves (97) being configured and said cylinder (95) being urged by a spring (98) in its resting position in which it is seated by its one end face on the tank-side bottom of said valve space (93) in which a fuel feed conduit (99) coming from said fuel tank ports, and a spring (100) being seated on the tank side in the drilled passage to receive said plunger (96), said spring urging said plunger (96) against the pressure conduit-side bottom of said valve space (93) so that said drilled passage (92) is covered, a vacant space (95*a*) being formed in the tank-side inner space of said cylinder (95) for said plunger (96).

68. An oil burner for a heating system including a combustion chamber into which fuel is fed by a fuel feed element, characterized in that said fuel feed element is an injection device operating on the principle of energy storage comprising a pump (1) and a nozzle device (3) which delivers bursts of fuel in specified quantities, and including a means delaying said fuel flow, by the actuation of which the kinetic energy of the accelerated fuel is converted abruptly into a shock wave ejecting the fuel via said nozzle device.

69. The oil burner as set forth in claim 68, characterized in that a common electronic control means (608) is provided for said pump (602) and said electrically actuatable delay means (606).

* * * * *